US007953341B2

(12) United States Patent
Tobinaga et al.

(10) Patent No.: US 7,953,341 B2
(45) Date of Patent: May 31, 2011

(54) AUTOMATIC DOCUMENT FEEDER, IMAGE READING SYSTEM INCLUDING SAME, AND IMAGE FORMING APPARATUS INCLUDING SAME

(75) Inventors: Hideki Tobinaga, Tokyo (JP); Tatsuaki Nagano, Yokohama (JP); Yasuo Kosuga, Kawasaki (JP); Norio Kimura, Sagamihara (JP); Takeshi Akai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 338 days.

(21) Appl. No.: 12/155,426

(22) Filed: Jun. 4, 2008

(65) Prior Publication Data

US 2008/0308995 A1 Dec. 18, 2008

(30) Foreign Application Priority Data

Jun. 14, 2007 (JP) ..... 2007-157650

(51) Int. Cl.
*G03G 21/20* (2006.01)

(52) U.S. Cl. ..... 399/92

(58) Field of Classification Search ..... 399/92
See application file for complete search history.

(56) References Cited

U.S. PATENT DOCUMENTS 5,095,333 A * 3/1992 Shimada ..... 399/92
5,144,366 A * 9/1992 Sakamoto et al. ..... 399/92
5,263,697 A 11/1993 Yamazaki et al.
6,499,960 B2 * 12/2002 Chen ..... 417/32
7,433,624 B2 * 10/2008 Ohkura ..... 399/92
2005/0179963 A1 * 8/2005 Nagano et al. ..... 358/475
2007/0211312 A1 * 9/2007 Tokutsu ..... 358/498
2007/0264063 A1 11/2007 Sano et al.

FOREIGN PATENT DOCUMENTS

JP 2003090976 A * 3/2003
JP 2003-159857 6/2003
JP 2004-018198 1/2004
JP 2005-321723 11/2005
JP 2006-133279 5/2006
JP 2006-243602 9/2006

* cited by examiner

*Primary Examiner* — Stefanos Karmis
*Assistant Examiner* — Ernesto Suarez
(74) *Attorney, Agent, or Firm* — Harness, Dickey & Pierce, P.L.C.

(57) ABSTRACT

An automatic document feeder, included in an image reading system that can be included in an image forming apparatus, is configured to transfer an original document to an image reader included in the image reading system, and includes a first drive unit configured to include a first motor to drive the document separation and feed unit, a second drive unit configured to include a second motor to drive the document conveyance unit, a third drive unit configured to include a third motor to drive the document discharging unit, where at least two motors of the first, second, and third motors disposed in a substantially in-line arrangement, and a cooling member configured to supply a coolant to the at least two motors disposed in a substantially in-line arrangement, to the first, second, and third motors, in that order.

14 Claims, 26 Drawing Sheets

AUTOMATIC DOCUMENT FEEDER, IMAGE READING SYSTEM INCLUDING SAME, AND IMAGE FORMING APPARATUS INCLUDING SAME

CROSS-REFERENCE TO RELATED APPLICATION

The present patent application claims priority under 35 U.S.C. §119 from Japanese Patent Application No. 2007-157650 filed on Jun. 14, 2007 in the Japan Patent Office, the contents and disclosure of which are hereby incorporated by reference herein in their entirety.

BACKGROUND

1. Field

Example embodiments of the present patent application generally relate to an automatic document feeder, an image reading system including the automatic document feeder, and an image forming apparatus including the automatic document feeder or including the image reading system with the automatic document feeder. More particularly, the present patent application relates to an automatic document feeder that conveys an original document, an image reading system that includes the automatic document feeder and reads the original document a scanning position, and an image forming apparatus that includes the image reading system having the automatic document feeder.

2. Discussion of the Related Art

A known automatic document feeder or ADF feeds an original document from a document stack accommodated in a document holder and conveys the original document to a scanning position of an image reader to be read or scanned.

Recently, such ADF has been increasing the number of motor rotations to convey the original document, so as to accelerate a conveyance speed of the original document in order to increase the number of processed original documents per unit time. This generally causes an increase in the value of the current supplied to the motor and a consequent increase in the amount of heat generated by the motor, necessitating appropriate temperature-control countermeasures. Particularly where a stepping motor is used, such increases in current cause an increase in load on the motor driver, again requiring appropriate temperature control. In a further effort to improve productivity, the drive duty of a solenoid, which is widely used for driving a path selector to select a sheet conveyance path, is increased.

Under these circumstances, effective temperature control is required to prevent an unmanageable increase in temperature inside the image forming apparatus.

One well-known, cost-effective cooling member or heat radiator to cool down motors, etc. is a high thermal conductive material such as a metallic plate. Employing a high thermal conductive rubber for a motor damper is also known to be effective. However, market demand for downsizing and weight saving of the ADF has led to a reduction of space for cooling and have increased the use of plastic parts that have low thermal conductivity, which hinders effective cooling of the motors, etc.

Consequently, one approach is to provide multiple fan motors for each of the several different motors employed in the image forming apparatus, such as a motor for driving a mechanism for feeding each original document from a document stack or a motor for driving a document conveyance unit that conveys the fed original document to the scanning position.

Although providing multiple fan motors is more effective than the use of metallic plate and other members, such an approach prevents the related-art ADF from reducing space inside machine as well as reducing production cost and overall machine size.

Thus, there is a need for a compact, cost-effective ADF, an image reading system including the ADF and an image reader, and an image forming apparatus including the image reading system including the image reading system with the ADF to overcome the above-described and other problems.

SUMMARY

In light of the foregoing, the inventors of the present patent application previously propose to provide an automatic document feeder that is small and cost-effective and can eliminate the above-described drawbacks, specifically, by reducing machine size, costs, power consumption, noise, etc. and increasing cooling effect, an image reading system using the automatic document feeder, and an image forming apparatus including the image reading system including the automatic document feeder.

One or more example embodiments of the present patent application has been made, taking the above-described circumstances into consideration.

An embodiment of the present patent application provides an automatic document feeder that includes a document separation and feed unit, a document conveyance unit, a document discharging unit, a first drive unit, a second drive unit, a third drive unit, and a cooling member. The document separation and feed unit is configured to separate an original document placed on top of an original document stack on an original document stacker and feed the original document to be scanned. The document conveyance unit is configured to convey the original document separated and fed by the document separation and feed unit to a scanning position on an image reader. The document discharging unit is configured to discharge the original document conveyed to the scanning position by the document conveyance unit to a document discharging member. The first drive unit is configured to include a first motor to drive the document separation and feed unit. The second drive unit is configured to include a second motor to drive the document conveyance unit. The third drive unit configured to include a third motor to drive the document discharging unit. At least two motors of the first motor, the second motor, and the third motor are disposed in a substantially in-line arrangement. The cooling member is configured to supply a coolant to the at least two motors disposed in a substantially in-line arrangement, to the first motor, the second motor, and the third motor, in that order.

The cooling member may include a fan motor and the coolant includes air, and the fan motor may supply air.

The above-described automatic document feeder may further include a discharge outlet arranged on a main body thereof to discharge the coolant and disposed upstream from a motor of the first motor, second motor, and third motor which is disposed at an extreme downstream side in a direction of supply of the coolant to the motors.

The main body of the automatic document feeder may be connected to a main body of the image reader via a pair of openably closeable hinging units. The pair of openably closeable hinging units may be attached to the main body of the automatic document feeder via first and second hinging unit attachment members, respectively. The discharge outlet may be disposed in a gap between the first hinging unit attachment member and the main body of the automatic document feeder. The main body may include an intake inlet configured to take the coolant into the main body of the automatic document feeder and may be disposed in a gap between the second hinging unit attachment member and the main body of the automatic document feeder.

The above-described automatic document feeder may further include a guide member configured to guide the coolant supplied from the cooling member to a farthest motor, of the first motor, second motor, and third motor, which is disposed at an extreme downstream side from the cooling member.

The guide member may include a supporting member including the at least two motors among the first motor, the second motor, and the third motor, and a wall plate included in the main body of the automatic document feeder disposed facing the supporting member.

The above-described automatic document feeder may further include a drive controller configured to control the cooling member. The drive controller may start driving the cooling member when a given number of original documents is separated and fed from the start of transfer of the original documents accommodated on the original document stacker.

The drive controller may stop driving the cooling member after a given period of time has passed since a completion of transfer of original documents.

The above-described automatic document feeder may further include a temperature detector configured to detect a temperature of a farthest motor, of the first motor, second motor, and third motor, which is disposed at an extreme downstream side from the cooling member. The drive controller may start driving the cooling member when the temperature of the farthest motor detected by the temperature detector is at or above a given value.

The drive controller may stop driving the cooling member when the temperature of the farthest motor detected by the temperature detector is below the given value.

The above-described automatic document feeder may further include a drive controller configured to control the cooling member. The drive controller may start driving of the cooling member when a given period of time has passed from the start of transfer of original documents accommodated on the original document stacker.

The drive controller may stop driving the cooling member after a given period of time has passed since a completion of transfer of original documents.

The above-described automatic document feeder may further include a temperature detector configured to detect a temperature of a farthest motor, of the first motor, second motor, and third motor, which is disposed at an extreme downstream side from the cooling member. The drive controller may start driving the cooling member when the temperature of the farthest motor detected by the temperature detector is at or above a given value.

The drive controller may stop driving the cooling member when the temperature of the farthest motor detected by the temperature detector is below the given value.

At least one embodiment of the present patent application provides an image reading system that includes an image reader configured to read an image on an original document at a scanning position, and the above-described automatic document feeder.

At least one embodiment of the present patent application provides an image forming apparatus that includes an image forming unit configured to reproduce an image of an original document on a recording medium, and the above-described image reading system including the above-described automatic document feeder.

BRIEF DESCRIPTION OF THE DRAWINGS

The accompanying drawings are intended to depict example embodiments of the present patent application and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
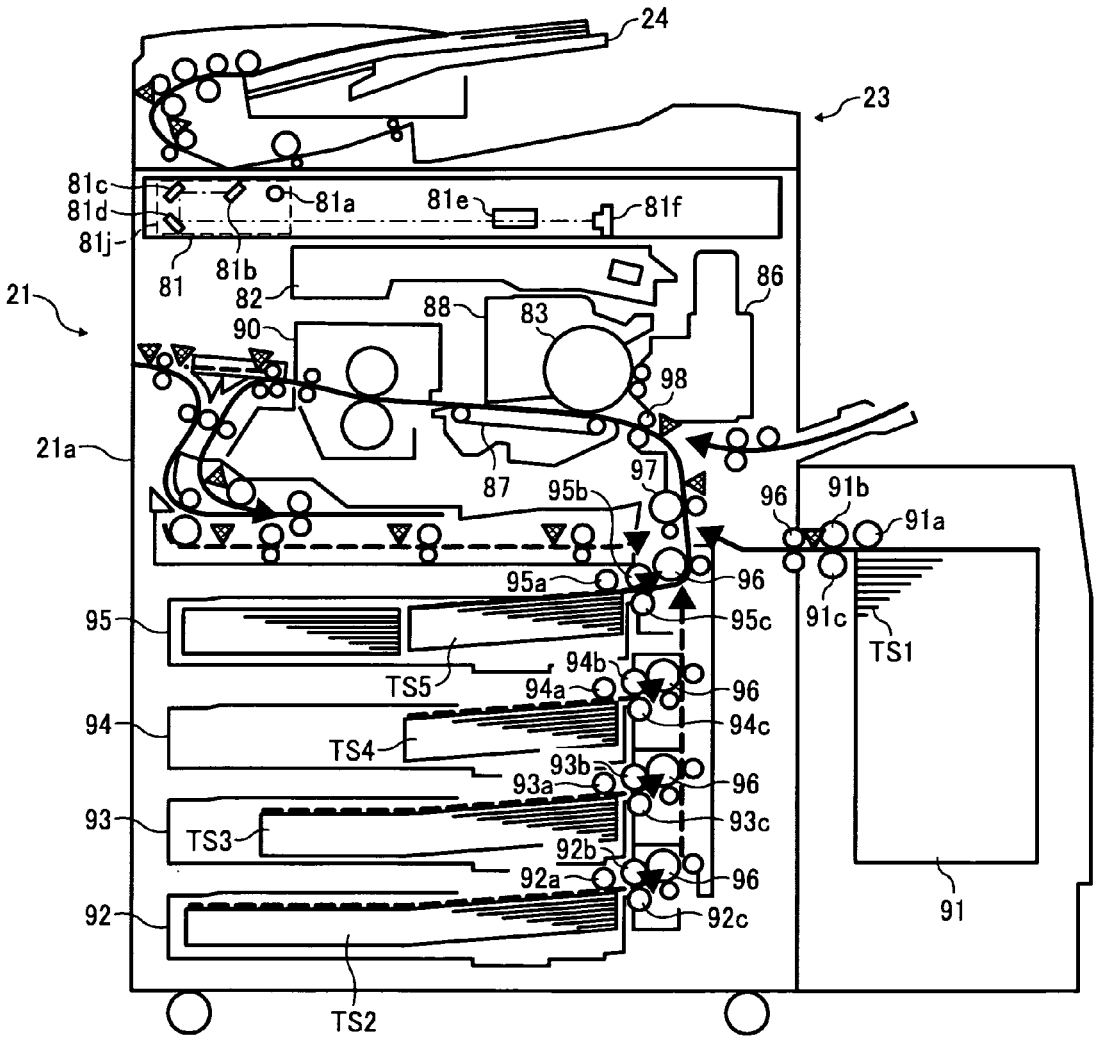
FIG. 1 is a schematic configuration of an image forming apparatus according to an example embodiment of the present patent application, including an image reading system according to an example embodiment of the present patent application.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

Now, example embodiments of the present patent application are described in detail below with reference to the accompanying drawings.

Descriptions are given, with reference to the accompanying drawings, of examples, example embodiments, modification of example embodiments, etc., of an automatic document feeder according to the present patent application, an image reading system, according to the present patent application, including the automatic document feeder and an image reader, and an image forming apparatus, according to the present patent application, including the image reading system according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of example embodiments of the present patent application.

The present patent application includes a technique applicable to any automatic document feeder, an image reading system including the automatic document feeder, and an image forming apparatus including the image reading system with the automatic document feeder. For example, the technique of the present patent application is implemented in the most effective manner in an electrophotographic image forming apparatus including an automatic document feeder and an image reading system including the automatic document feeder.

FIGS. 1 through 29 show an automatic document feeder, according to an example embodiment of the present patent application, an image reading system, according to an example embodiment of the present patent application, including the automatic document feeder, and an image forming apparatus, according to an example embodiment of the present patent application, including the image reading system having the automatic document feeder.

In an example embodiment, an image forming apparatus corresponds to a copier 21, and the image reading system corresponds to a combination of an automatic document feeder or ADF 23 and an image reader or scanner 81.

Instead of the copier 21, the image forming apparatus can include a facsimile machine, printer, and multiple image forming apparatus including at least two functions of copier, facsimile machine, and the like. In addition, instead of a combination of the ADF 23 and the scanner 81, the image reading system can include a single scanner, facsimile machine, and multiple image forming apparatus having at least two functions of copier, facsimile machine, and the like.

In FIG. 1, the copier 21 includes a copier main body 21*a* that includes a contact glass 22*a* (see FIG. 2), a slit glass 22*b* (see FIG. 2), and various image forming units and components of the copier 21 so as to form an image on a recording medium.

The contact glass 22*a* includes a translucent member, and is mounted on the top of the copier main body 21*a*.

The slit glass 22*b*, which includes a scanning position 80, is also mounted on the top of the copier main body 21*a* and next to the contact glass 22*a*. The slit glass 22*b* (see FIG. 2) also includes a translucent member and has a smaller area than the contact glass 22*a*.

Above the copier main body 21*a*, the ADF 23 is mounted. The ADF 23 is hinged or attached via a pair of openably closeable hinging units 20*a* and 20*b* to the copier main body 21*a*, so that the contact glass 22*a* can be selectively covered or uncovered.

For example, the pair of hinging units 20*a* and 20*b* each includes a first bracket 204*a* attached to the copier main body 21*a*, and a second bracket 204*b* attached to an ADF main body 23*a* of the ADF 23. The first bracket 204*a* and the second bracket 204*b* are rotatably connected to each other via a rotary shaft 204*c*.

The second bracket 204*b* includes a compression spring, not shown, therein. When the ADF main body 23*a* of the ADF 23 opens, the compression spring of the second bracket 204*b* is compressed to retain the ADF 23 to an open position thereof.

Figure 5:
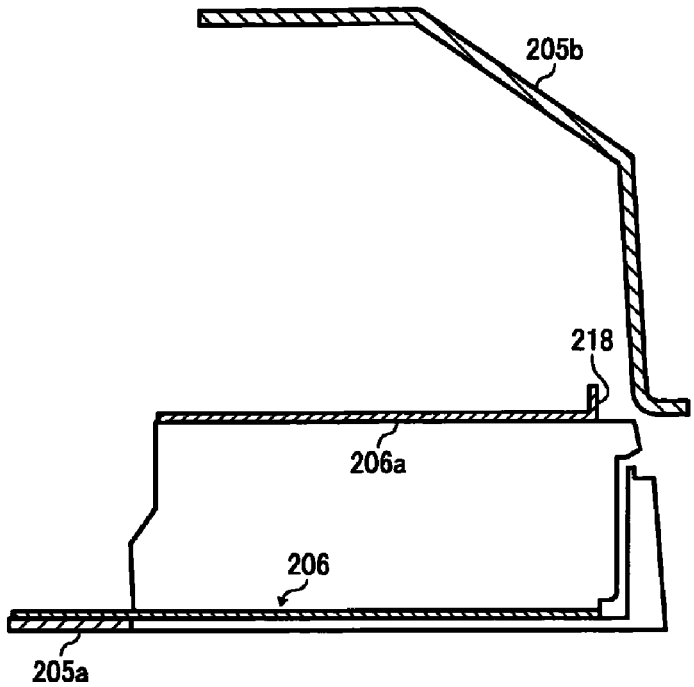
FIG. 5 is a cross-sectional view showing a far side of a main body of the automatic document feeder of FIG. 2.

FIG. 5 illustrates a far side of the ADF main body 23*a* of the ADF 23. As shown in FIG. 5, the ADF main body 23*a* includes a lower cover 205*a* and an upper cover 205*b*. The lower cover 205*a* can mount a hinging unit attachment frame 206 thereon, as shown in FIGS. 5, 6 and 7.

As shown in FIG. 8, a hinging unit attachment bracket 206*a* is attached to the hinging unit attachment frame 206. The hinging unit attachment bracket 206*a* is U-shaped and may be engaged with the first bracket 204*a* of the hinging unit 20*a*. In this example embodiment, the hinging unit attachment bracket 206*a* serves as a hinging unit attachment member.

Figure 6:
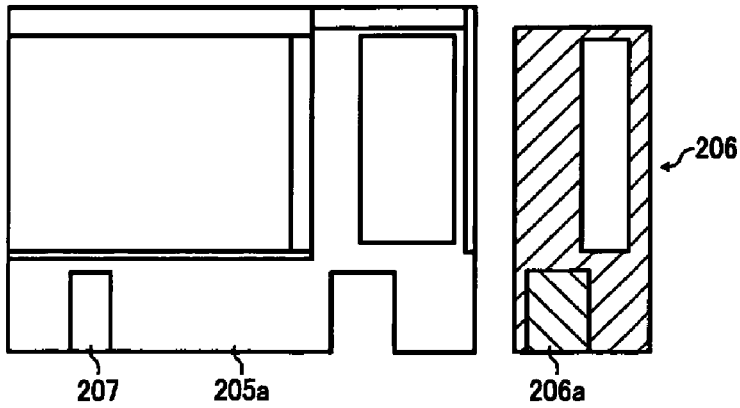
FIG. 6 is an exploded view of a lower cover and a hinging unit attachment frame of the automatic document feeder of FIG. 2.
Figure 7:
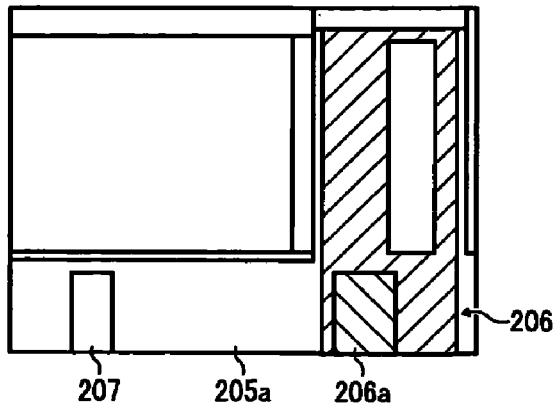
FIG. 7 is a top view of the lower cover with the hinging unit attachment frame mounted thereon.

The lower cover 205*a* can also mount another hinging unit attachment bracket 207 serving as a hinging unit attachment member thereof, as shown in FIGS. 6 and 7. The hinging unit attachment bracket 207 may be engaged with the first bracket 204*a* of the hinging unit 20*b*.

Figure 8A:
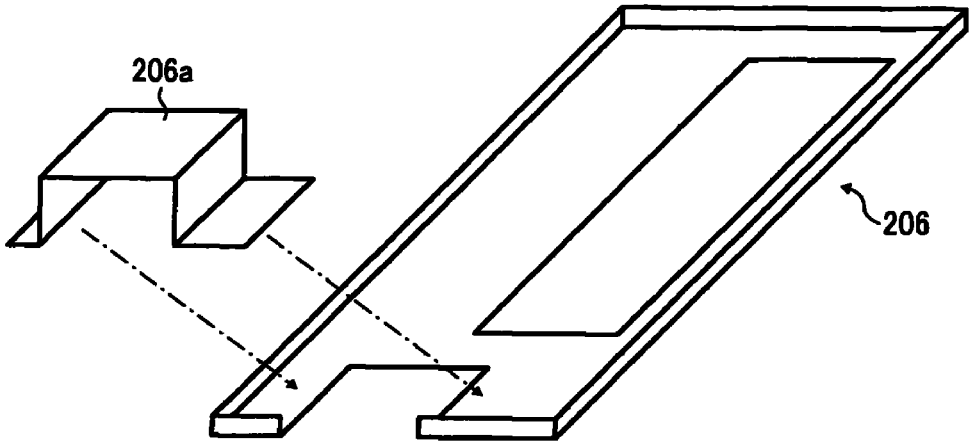
FIG. 8A is an exploded view of the hinging unit attachment frame and a hinging unit attachment bracket.
Figure 8B:
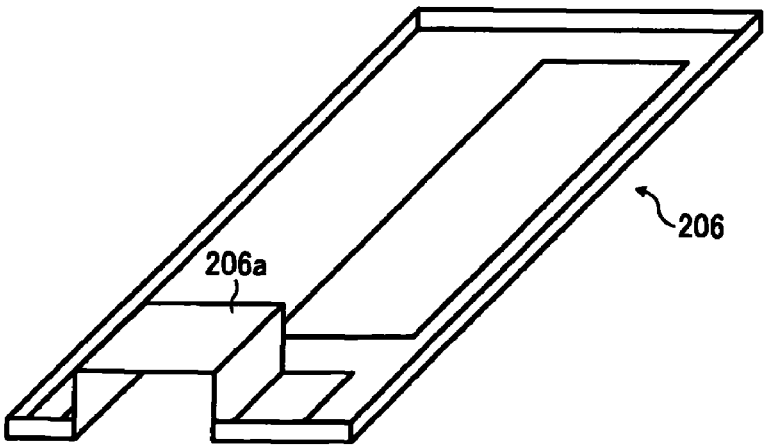
FIG. 8B is a top view of the hinging unit attachment frame with the hinging unit attachment bracket mounted thereon.

FIG. 6 is an exploded view of the lower cover 205*a* and the hinging unit attachment frame 206. FIG. 7 is a top view of the lower cover 205*a* with the hinging unit attachment frame 206 mounted thereon. FIG. 8A is, an exploded view of the hinging unit attachment frame 206 and the hinging unit attachment bracket 206*a*. FIG. 8B is a top view of the hinging unit attachment frame 206 with the hinging unit attachment bracket 206*a* mounted thereon.

FIG. 5 illustrates the hinging unit attachment bracket 206*a* when the first bracket 204*a* is not mounted thereon. An outlet 218 that serves as an exit of a coolant is arranged between the hinging unit attachment bracket 206*a* and the upper cover 205*b*.

Figure 4:
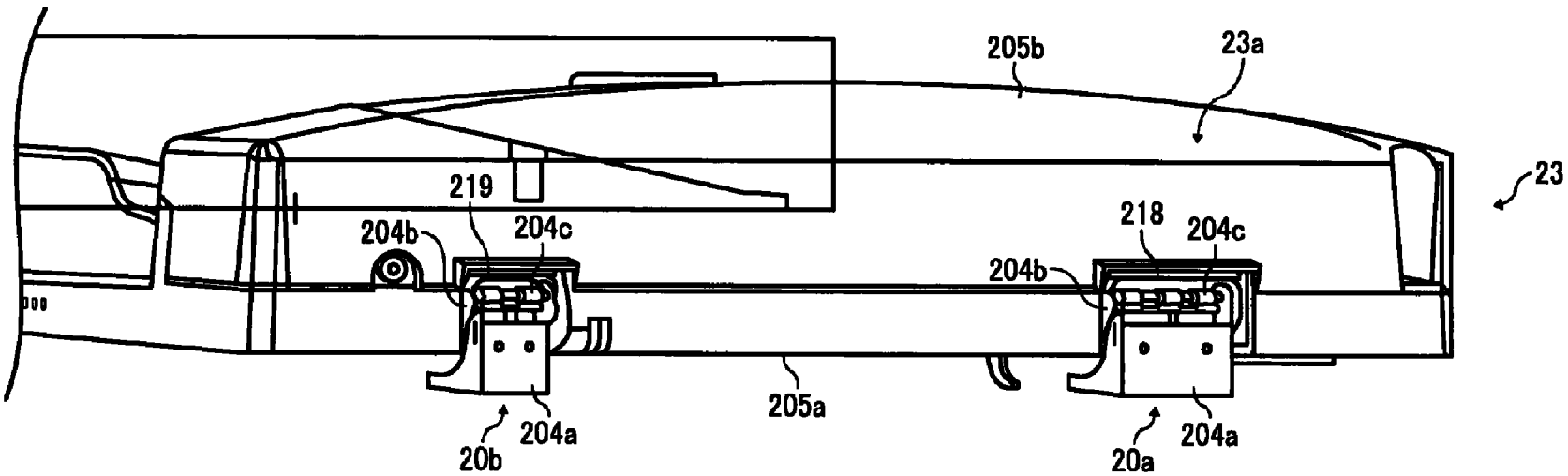
FIG. 4 is a rear view of the automatic document feeder of FIG. 2.

Further, as shown in FIG. 4 depicting a back side of the ADF 23, an inlet 219 serving as an entrance of the coolant is arranged between the hinging unit attachment bracket 207 and the upper cover 205*b*. The inlet 219 includes a same condition as the outlet 218.

The copier 21 includes other various image forming components and parts, such as the image reader or scanner 81, which will be described later. The scanner 81 and the ADF 23 form an image reading system 20 to feed and transfer original documents, including electronic papers and non-electronic media or papers to be read effectively.

Figure 2:
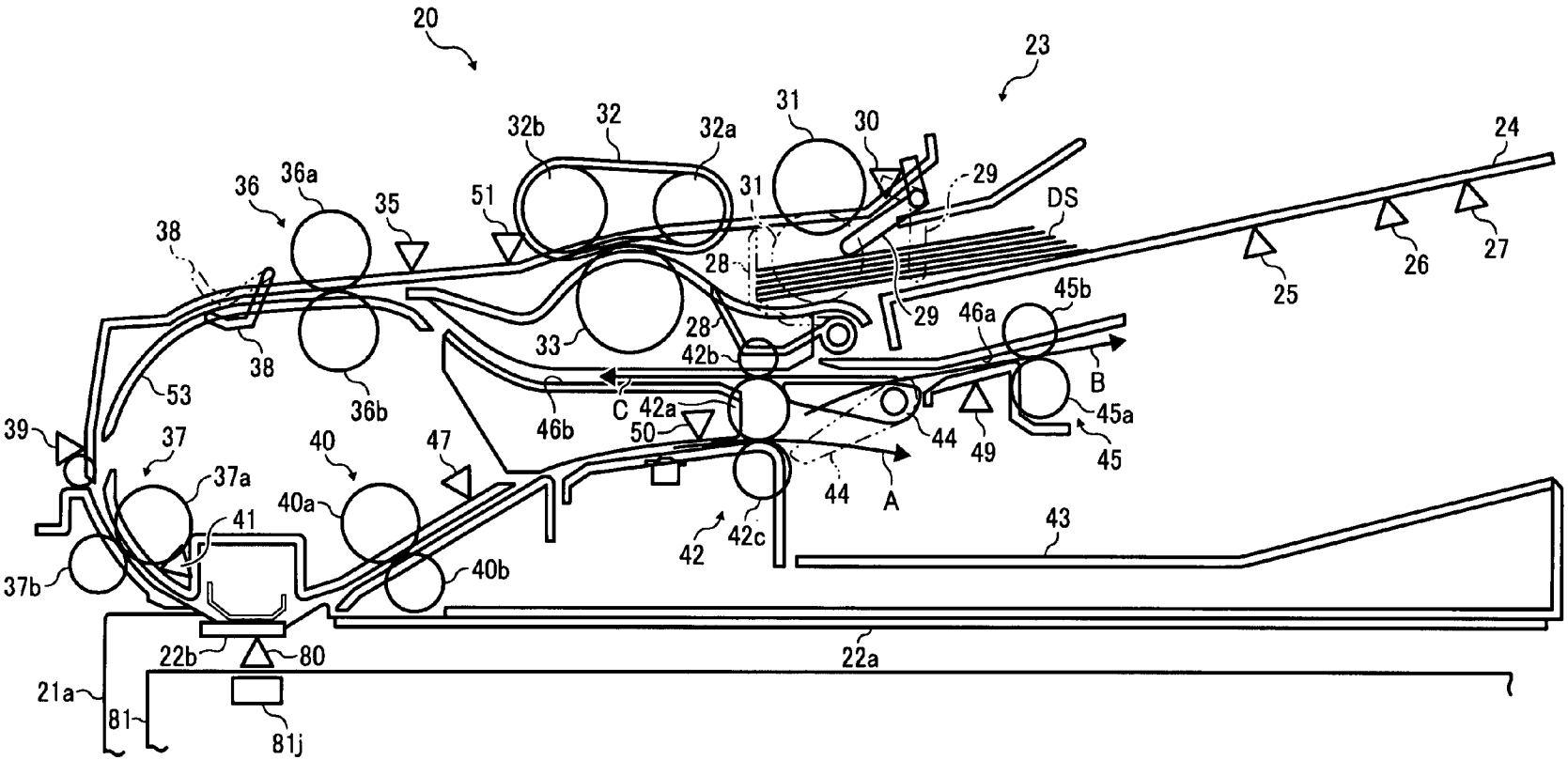
FIG. 2 is a schematic configuration (according to an example embodiment of the present patent application) of the image reading system of FIG. 1, including an automatic document feeder according to an example embodiment of the present patent application and an image reader according to an example embodiment of the present patent application.
Figure 3:
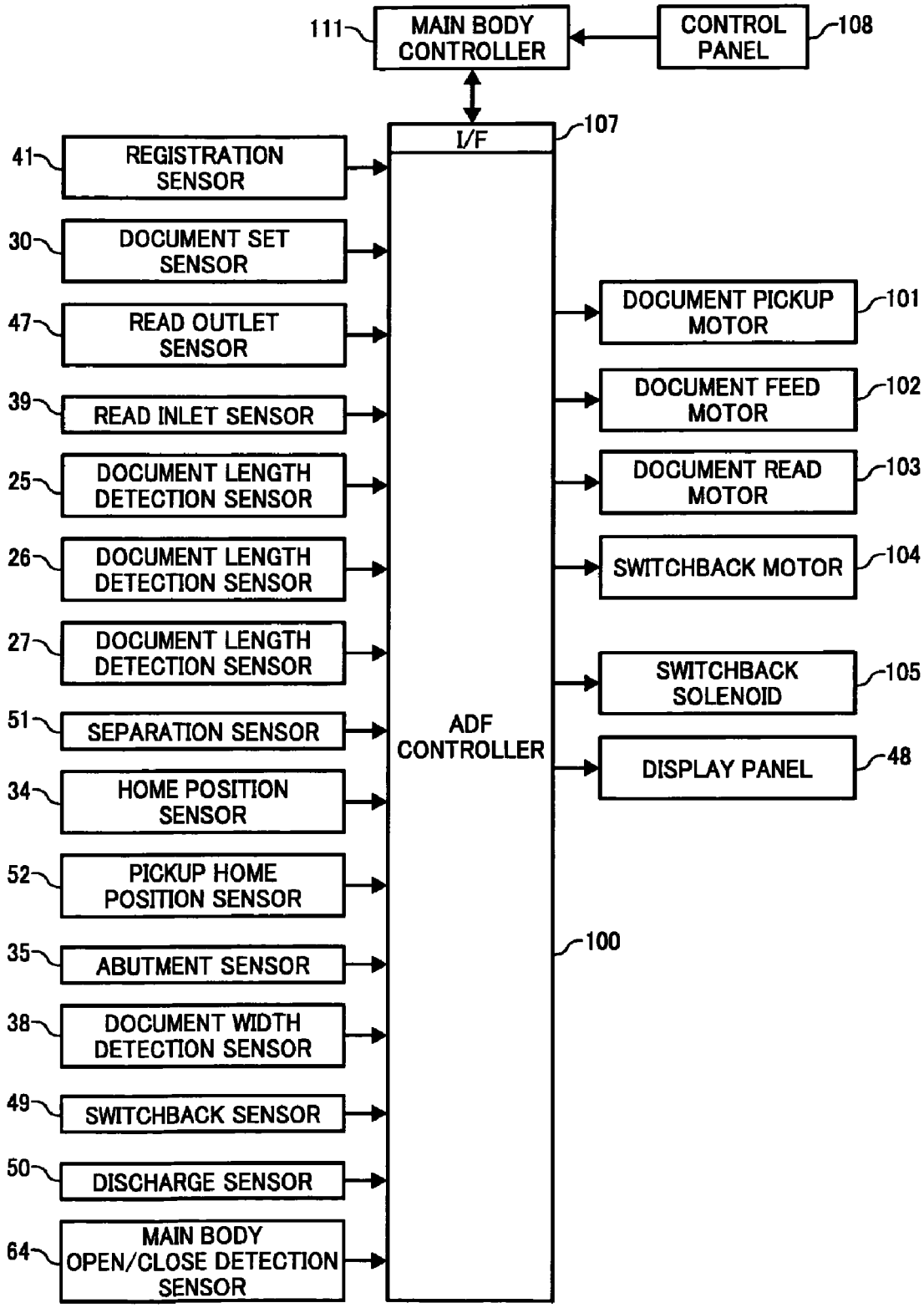
FIG. 3 is a block diagram (according to an example embodiment of the present patent application) of a control system of the image reading system of FIG. 1, according to an example embodiment of the present patent application.

Next, details of a configuration of the ADF 23 and operations performed by the ADF 23 and the scanner 81 forming the image reading system 20 are described, in reference to FIGS. 2 and 3.

FIG. 2 is a schematic configuration of the image reading system 20 including the ADF 23 connected to the image reader or scanner 81 provided to the copier main body 21*a*. FIG. 3 is a block diagram of the image reading system 20, focusing on an ADF controller 100 of the ADF 23 according to the first example embodiment of the present patent application.

In FIG. 2, the ADF 23 serves as a drive controller and includes a document setting table 24 that serves as an original document stacker. On the document setting table 24, an original document stack DS that is a stack of original documents are placed in a face-up manner.

In the ADF 23, document length detection sensors 25, 26, and 27 are mounted on a table part of the document setting table 24. The document length detection sensors 25, 25, and 27 serve as document length detecting member. Each of the length detection sensors 25, 25, and 27 includes a combination of a light receiving element and a light emitting element.

Specifically, the length detection sensors 25, 25, and 27 are disposed on the document setting table 24 so as to determine at least an orientation (i.e., portrait or landscape) of the same size of the original documents.

The ADF controller 100 determines the length of the original document stack DS in a document travel direction of the original document stack DS accumulated on the document setting table 24, based on information input from the light receiving elements of the length detection sensors 25, 26, and 27.

A document stopper 28 is disposed at a downstream side of the document setting table 24 in the document travel direction. The document stopper 28 serves as a stopping member to move between an abutment position that is indicated by a chain double-dashed line in FIG. 2 and a home position that is indicated by a solid line in FIG. 2. A document pickup motor 101 (see FIG. 3) may cause the document stopper 28 to move to the abutment position when aligning the leading edge of the original document stack DS and to move to the home position when retreating therefrom.

In addition, by abutting the original document stack DS to side fences, not shown, mounted on the document setting table 24, the width direction of the original document stack DS can be positioned in a direction perpendicular to the document travel direction of each original document.

When the document stopper 28 moves in a downward direction toward the home position, a home position sensor 34 may detect the movement of the document stopper 28 and output the detection result to the ADF controller 100.

On the original document setting table 24 at a side of the leading edge of the original document stack DS, a document set filler 29 and a document set sensor 30 including a transmission photosensor are mounted.

When the original document stack DS is mounted on the document setting table 24, the leading edge of the original document stack DS pushes the document set filler 29, therefore, the document set filler 29 may move from a position that is indicated by a chain double-dashed line in FIG. 2 to a position that is indicated by a solid line in FIG. 2. When the document set filler 29 changes its position from the undetected state of the original document stack DS to the detected state of the original document stack DS, the document set sensor 30 may output a signal to the ADF controller 100.

The ADF controller 100 is connected to a main body controller 111 via an interface or I/F 107 and outputs the signal to the I/F 107. The main body controller 111 is mounted on the copier main body 21*a* of the copier 21.

Based on the input signal, the main body controller 111 may shift to a standby condition for reading original documents in the copier main body 21*a* by the image reader 81. Hereinafter, the image reader 81 is referred to as a "scanner 81."

Above the document stopper 28, a document pickup roller 31 that serves as a document pickup member is disposed. The document pickup roller 31 may transmit the driving force from the document pickup motor 101 via a document pickup cam 126, which will be described later. The document pickup motor 101 and the document pickup cam 126 may cause the document pickup roller 31 to move in a vertical direction between a home position that is indicated by a solid line in FIG. 2 to retreat from the original document stack DS and a contact position that is indicated by a chain double-dashed line in FIG. 2 to contact with the top of the original document stack DS.

When the document pickup roller 31 moves in an upward direction toward its home position, a pickup roller home position sensor 52 may detect the movement of the document pickup roller 31 and output the detection result to the ADF controller 100.

When a print key that is displayed on a control panel 108 mounted on the copier main body 21*a* is pressed, the main body controller 111 may transmit a document pickup signal via the I/F 107 to the ADF controller 100. After receiving the document pickup signal, the ADF controller 100 may drive the document pickup motor 101 to rotate in a normal direction so as to cause the document stopper 28 to move in a downward direction to retreat from the original document stack DS.

When operations using the control panel 108 start, a buzzer sounds. According to the buzzer, the ADF controller 100 detects the input operations of the control panel 108.

When the document stopper 28 moves to the home position, the home position sensor 34 may detect the movement of the document stopper 28, and the ADF controller 100 may drive the document pickup motor 101 in a reverse direction so as to cause the document pickup roller 31 to move down to a position to contact with the original document stack DS.

At this time, a document feed motor 102 (see FIG. 3) may rotate in a normal direction, which may cause the document pickup roller 31 to start feeding original documents, desirably one document sheet, from the original document stack DS accumulated on the document setting table 24. The fed original document may be transferred to a document feeding belt 32 and a reverse roller 33 both disposed downstream from the document pickup roller 31 in the document travel direction.

The document feeding belt 32 shown in FIG. 2 serves as a document separation and feed unit, and is extended by and spanned around a drive roller 32*a* and a driven roller 32*b*. When the driving force of the document feed motor 102 is transmitted to the drive roller 32*a*, the document feeding belt 32 in a shape of an endless loop may rotate.

When the document feed motor 102 is rotated in a normal direction, the document feeding belt 32 may rotate to move an original document in the document travel direction, which is a rotation in a clockwise direction in FIG. 2.

The reverse roller 33 also serves as a document separation and feed unit, and includes a torque limiter, not shown. When the document feed motor 102 is rotated in a normal direction, the reverse roller 33 may be rotated in a direction opposite to the document travel direction, which is a rotation in a counterclockwise direction in FIG. 2.

With the above-described operations, an original document placed on the top of the original document stack DS and a next original document placed immediately below the top original document may be separated and only the top original document may be fed.

Specifically, the reverse roller 33 may be held in contact with the document feeding belt 32 with a sufficient pressure. When being held in contact with the document feeding belt 32 directly or via one original document, the reverse roller 33 may rotate with the document feeding belt 32 in a counterclockwise direction. When two or more original documents enter between the document feeding belt 32 and the reverse roller 33, the force of the reverse roller 33 rotating with the document feeding belt 32 may be set to a value smaller than the torque of the torque limiter. Accordingly, the reverse roller 33 can rotate in a clockwise direction to push back extra original document(s), so as to reduce or prevent a chance of multi-feeding of original documents. Thus, the document feeding belt 32 and the reverse roller 33 separate an original document placed on top of the original document stack DS and feed the original document to be scanned.

The separately fed original document may be detected by a separation sensor 51 disposed downstream from the document feeding belt 32. The separation sensor 51 may serve as a separated document detection unit. The original document detected by the separation sensor 51 may be further transferred by the document feeding belt 32. When the original document proceeds by a reference amount of X mm after the leading edge of the original document is detected by an abutment sensor 35 that is disposed downstream from the document feeding belt 32, the ADF controller 100 may stop the rotation of the document feed motor 102 in the normal direction.

The reference amount of X mm is set to a distance that is greater than the distance between the abutment sensor 35 and a nip contact of a pair of pull-out rollers 36 that serves as a document separation and feed unit. That is, the original document transferred thereto may be stopped while being bowed in a constant manner with the leading edge thereof abut against the nip contact formed between a pull-out drive roller 36*a* and a pull-out driven roller 36*b* that are in sliding contact with each other.

At this time, according to the instructions from the ADF controller 100, the document pickup motor 101 rotates in a normal direction to retreat the document pickup roller 31 from the top surface of the original document and transfer the original document by the transfer force of the document feeding belt 32 only. By so doing, the leading edge of the original document abuts against the nip contact formed between the pull-out drive roller 36*a* and the pull-out driven roller 36*b* of the pair of pull-out rollers 36, thereby correcting the skew of the original document occurred when separated from the original document stack DS.

Further, after the skew of the original document is corrected by the reverse rotation of the document feed motor 102, the pull-out drive roller 36*a* and the pull-out driven roller 36*b* may transfer the original document toward a pair of read inlet rollers 37 disposed at the downstream side of the document transfer path via a reverse path 53. The pair of read inlet rollers 37 shown in FIG. 2 serves as a document conveyance unit, and includes a read inlet drive roller 37*a* and a read inlet driven roller 37*b*.

When the document feed motor 102 rotates in a reverse direction, the pull-out drive roller 36*a* may be rotated, however, the driving force thereof may not be transmitted to the document pickup roller 31 and the document feeding belt 32 because of the function of a later described one-way clutch.

Further, multiple document width detection sensors 38 are arranged downstream from the pull-out drive roller 36*a* and the pull-out driven roller 36*b*. The multiple document width detection sensors 38 are disposed or aligned along a direction perpendicular to the sheet of FIG. 2, so as to move between a position that is indicated by the solid line in FIG. 2 and a position that is indicated by the chain double-dashed line in FIG. 2.

When an original document is detected, the multiple document width detection sensors 38 may move to the position that is indicated by the chain double-dashed line. The document width detection sensors 38 may then obtain information of the width direction that runs perpendicular to the document travel direction of the original document transferred by the pull-out drive roller 36*a* and the pull-out driven roller 36*b*, and transmit the detection results to the ADF controller 100.

The ADF controller 100 may transmit, to the main body controller 111, information of the size of the original document stack DS accumulated on the document setting table 24, based on the detection results of the length of the original document obtained by the document length detection sensors 25, 26, and 27 and the detection results of the width of the original document obtained by the document width detection sensors 38.

Further, the ADF controller 100 may count the number of motor drive pulses that corresponds to a distance of the original document transferred while the abutment sensor 35 is detecting the leading edge and trailing edge of the original document. By counting the number of motor drive pulses, the correct length of an original document may be calculated.

Further, when the original document is transferred to the pair of read inlet rollers 37 according to rotation of the pull-out drive roller 36*a*, the transfer speed of the original document may be set to high speed to reduce a time period to transfer the original document to the scanning position 80 provided on the slit glass 22*b*. Specially, from a second original document and after, the high speed document transfer can reduce a distance between two sequentially processed original documents. This can enhance the productivity in conveyance or transfer of the original documents. When a read inlet sensor 39 detects the leading edge of the original document, the transfer speed may be decreased before the leading edge of the original document enters between the pair of read inlet rollers 37.

The ADF controller 100 may rotate and stop the document feed motor 102 so as to make the transfer distance longer by Y mm than the distance from the read inlet sensor 39 to the pair of read inlet rollers 37. The original document transferred to the nip contact of the pair of read inlet rollers 37 may be stopped while being bowed in a constant manner with the leading edge thereof abutting against the nip contact of the pair of read inlet rollers 37 that is being stopped. This can correct skew occurred when the pair of pull-out rollers 36 is conveying the original document.

In an example embodiment of the present patent application, the pair of read inlet rollers 37 may include a pair of rollers dedicated for correcting skew.

Further, when an original document is temporarily stopped at the nip contact of the pair of read inlet rollers 37 (which is referred to as a "registration stop"), the ADF controller 100 may transmit a registration stop signal to the main body controller 111 via the I/F 107.

When the registration stop signal is transmitted to the main body controller 111, the ADF controller 100 may receive a read start signal from the main body controller 111. The ADF controller 100 drives a document read motor 103 (see FIG. 3) so that the original document stopped at the nip contact of the pair of read inlet rollers 37 can be transferred at a transfer speed according to a read scan magnification for the original document, and causes a pair of read outlet rollers 40 to transfer the original document. The pair of read outlet rollers 40 serves as a document conveyance unit, and includes a read outlet drive roller 40*a* and a read outlet driven roller 40*b*.

When the read start signal is received before the leading edge of the original document reaches a registration sensor 41 that is mounted at an upstream side from the slit glass 22*b*, the ADF controller 100 may perform the reading operation without executing the registration stop. In this operation, the original document may not be stopped at the nip contact of the pair of read inlet rollers 37 and is transferred and scanned while the scan transfer speed is maintained.

When the registration sensor 41 detects the leading edge of the original document, the ADF controller 100 may start a pulse count or counting pulses of the document read motor 103. At the timing that the leading edge of the original document reaches the scanning position 80 on the slit glass 22*b*, the ADF controller 100 may transmit a gate signal that indicates a variable image area in a sub-scanning direction, to the main body controller 111. The ADF controller 100 generally keeps transmitting the gate signal until the trailing edge of the original document completely passes over the scanning position 80.

After passing over the scanning position 80 via the reverse path 53, the original document may be reversed from the front face to the reverse face and transferred by the pair of read outlet rollers 40 and a document discharging roller set 42 serving as a document conveyance unit. After a front face side of the original document are scanned or read, the original document may be discharged to a document discharging tray 43 that serves as a document discharging member.

Further, the document discharging roller set 42 includes a discharge drive roller 42*a*, an upper discharge driven roller 42*b*, and a lower discharge driven roller 42*c*. At a downstream side of the document discharging roller set 42, a path selector 44 is disposed.

When scanning the front face of a double face original document in transfer of the double face original document, before the leading edge of the double face original document passing over the scanning position 80 reaches the document discharging roller set 42, a switchback solenoid 105 (see FIG. 3) may drive the path selector 44 to be switched to the position indicated by the chain double-dashed line in FIG. 2.

At this time, the discharge drive roller 42*a* and the lower discharge driven roller 42*c* driven by the document read motor 103 and a pair of switchback rollers 45 driven by a document switchback motor 104 (see FIG. 3) may transfer the original document to a switchback path 46*a*, which serves as a switchback path and/or a reverse path. The pair of switchback rollers 45 serves as a document discharging unit, and includes a switchback drive roller 45*a* and a switchback driven roller 45*b*.

After a read outlet sensor 47 that is disposed downstream from the pair of read outlet rollers 40 has detected the trailing edge of the original document and the drive pulses of the document read motor 103 has reached a reference number of pulses, the ADF controller 100 may determine that the trailing edge of the original document has passed the document discharging roller set 42 and turn off the switchback solenoid 105 to move the path switching member 44 to the position that is indicated by the solid line shown in FIG. 2.

As previously described, after the number of drive pulses of the document read motor 103 has reached the reference number of pulses, the ADF controller 100 may drive the document switchback motor 104 to rotate in a reverse direction to rotate the pair of switchback rollers 45 in a reverse direction, thereby switching back the original document toward the pair of pull-out rollers 36.

At this time, the rotation direction of the document read motor 103 is in the normal direction and the rotation direction of the document switchback motor 104 is the opposite or reverse direction of the document transfer direction. The document switchback motor 104 and the document read motor 103 may be driven at high speed, thereby reducing the processing time.

After the switchback of the original document has been started, the number of drive pulses of the document switchback motor 104 may shortly reach the reference number of pulses. After that, the ADF controller 100 may drive the document feed motor 102 in a reverse direction at high speed, thereby transferring the original document to the pair of pull-out rollers 36 at high speed.

When a switchback sensor 49 detects the trailing edge of the original document that is transferred to a re-entry path 46*b*, which serves as a reverse path, the ADF controller 100 may stop the reverse rotation of the pair of switchback rollers 45, based on the detection results obtained from the switchback sensor 49.

After the stop of the pair of switchback rollers 45, the pair of pull-out rollers 36 may correct the skew of the original document, and thus, one side or front face of the original document is scanned. Then, the original document may be switched back again into the switchback path 46*a*, and pass through the re-entry path 46*b*, and be transferred toward the scanning position 80. Thus, the original document may be reversed without being scanned or read, be collated in a proper page order, and be discharged to the document discharging tray 43.

Further, a discharge sensor 50 is disposed upstream from the document discharging roller set 42. The discharge sensor 50 may detect the trailing edge of the original document to output a signal to the ADF controller 100. Based on the detection results, the ADF controller 100 may determine that the original document is discharged.

The copier main body 21*a* further includes a display panel 48. The ADF controller 100 may determine whether a jam has occurred, based on the respective detection results from the abutment sensor 35, the read inlet sensor 39, the registration sensor 41, the read outlet sensor 47, the switchback sensor 49, the discharge sensor 50, the document length detection sensors 25, 26, and 27, and so forth. When it is determined that the jam has occurred, the ADF controller 100 may display a message on the display panel 48 to inform the occurrence of jam.

The ADF 23 includes a main body open/close detection sensor 64 to detect that the ADF main body 23*a* has been lifted down or closed or the ADF main body 23*a* has been lifted up or opened.

The main body open/close detection sensor 64 includes a filler mounted on the ADF main body 23*a* of the ADF 23, and a transmission photosensor mounted on the copier main body 21*a* of the copier 21 to detect the filler. An output signal issued from the transmission photosensor is output from the ADF controller 100.

Referring to FIGS. 9 to 12, schematic structures of respective power transmission mechanisms are described.

Figure 9:
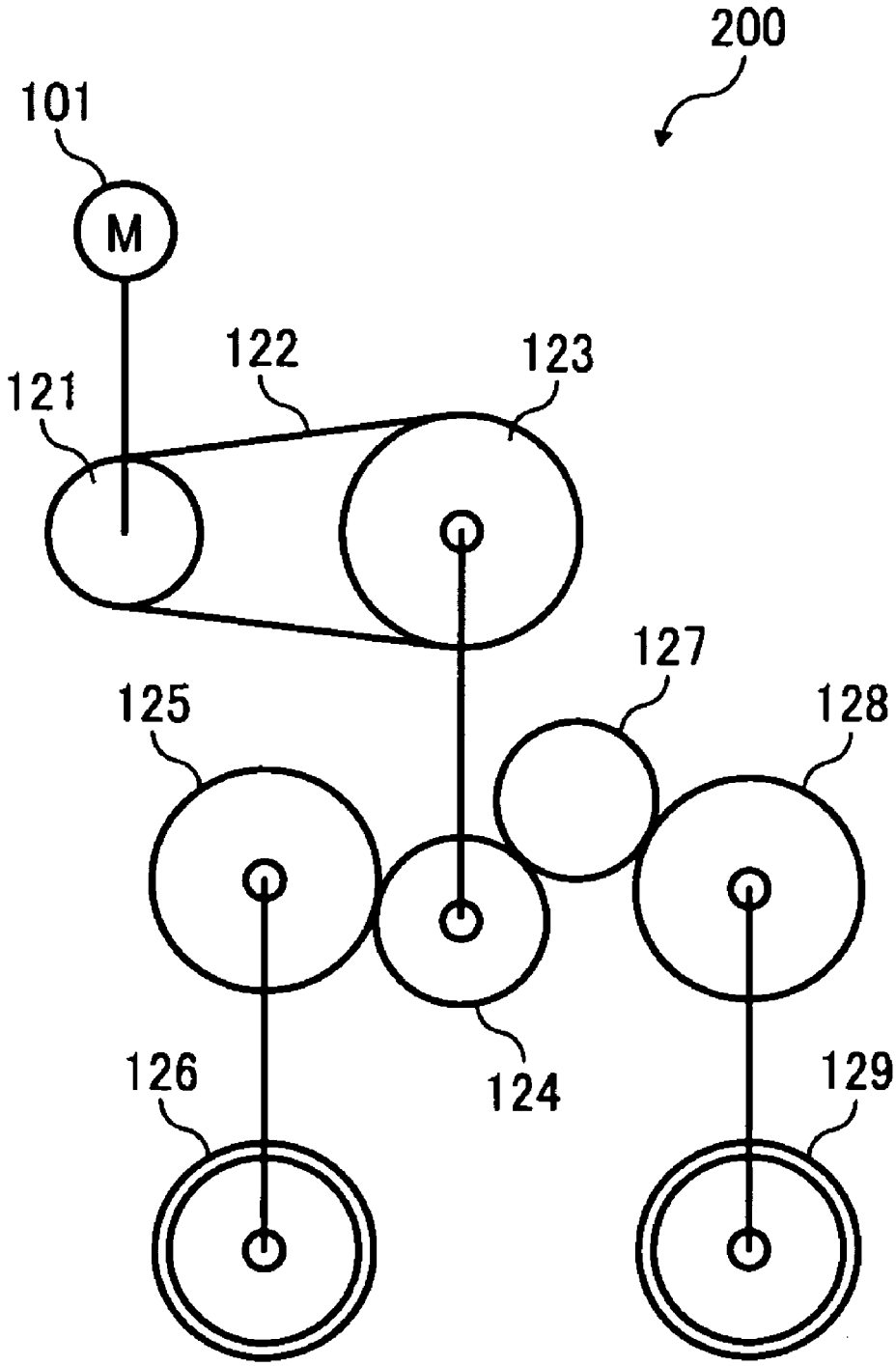
FIG. 9 is a schematic structure (according to an example embodiment of the present patent application) of a power transmission mechanism of the image forming apparatus of FIG. 1.
Figure 10:
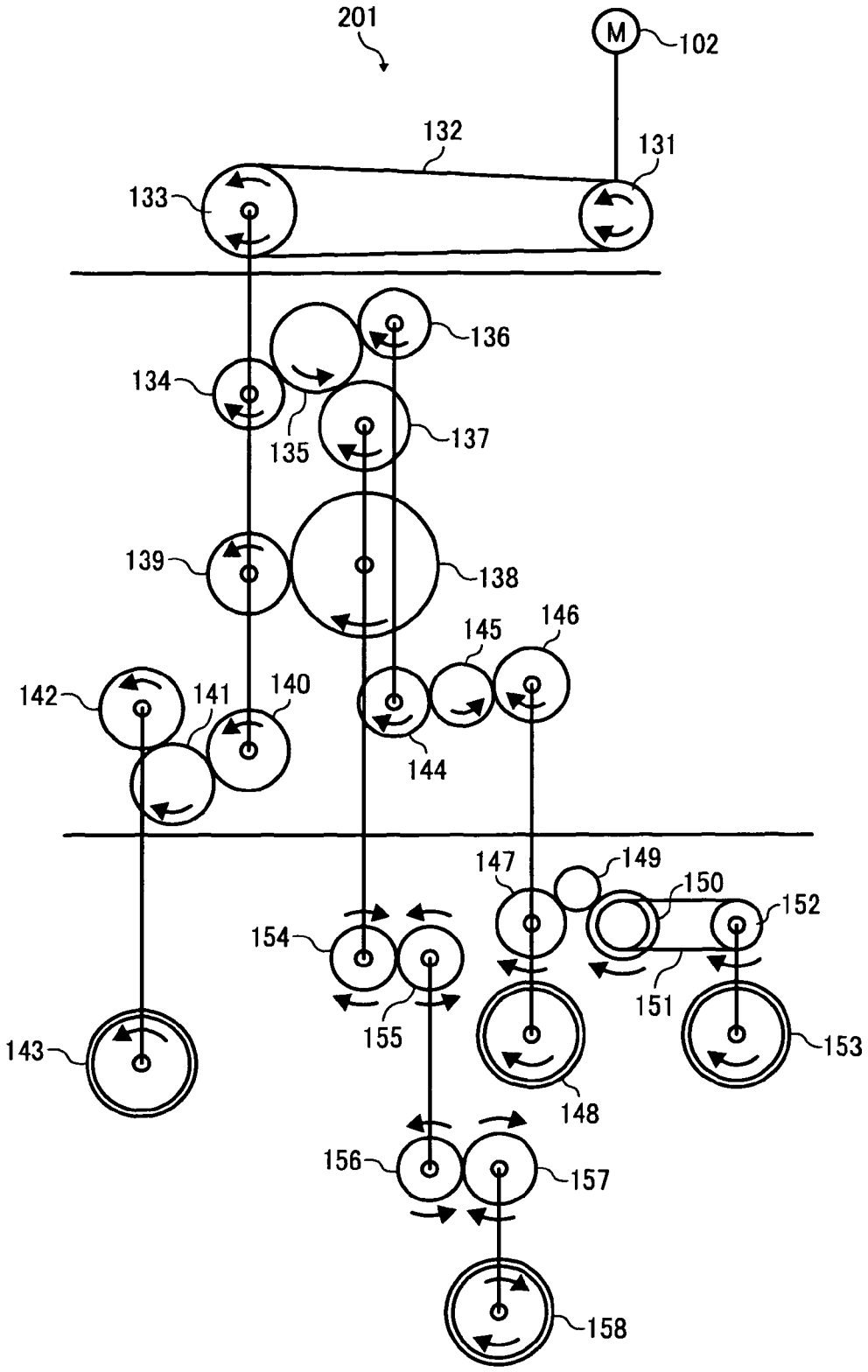
FIG. 10 is a schematic structure (according to an example embodiment of the present patent application) of another power transmission mechanism of the image forming apparatus of FIG. 1.
Figure 11:
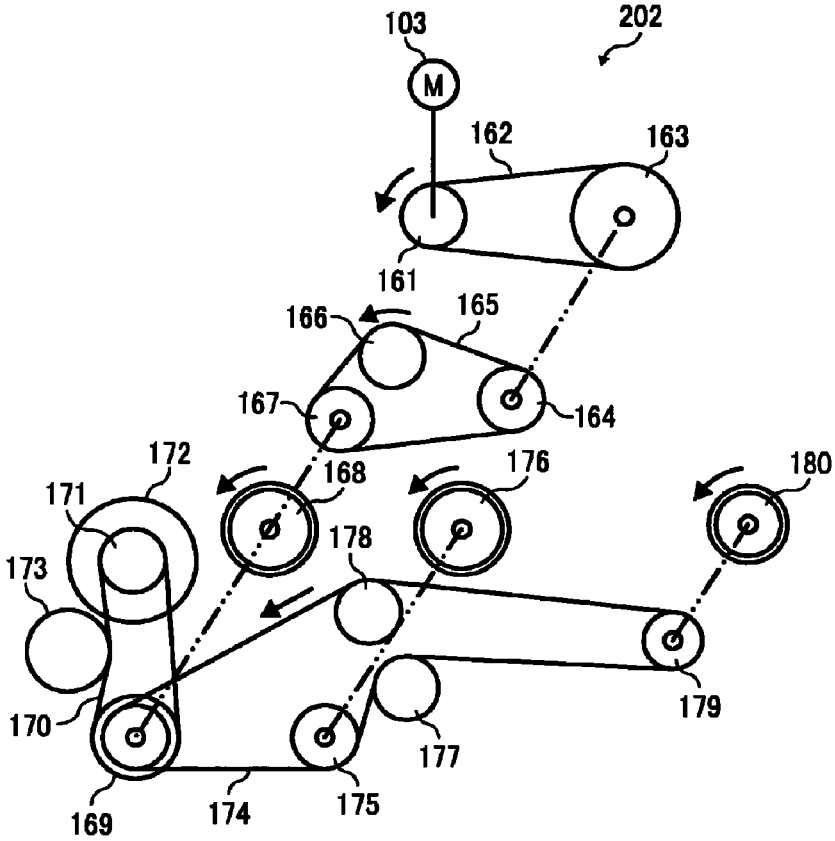
FIG. 11 is a schematic structure (according to an example embodiment of the present patent application) of another power transmission mechanism of the image forming apparatus of FIG. 1.
Figure 12:
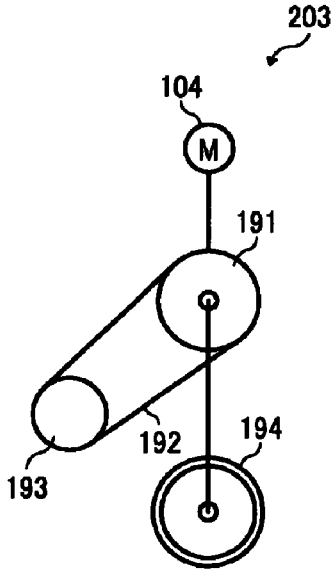
FIG. 12 is a schematic structure (according to an example embodiment of the present patent application) of another power transmission mechanism of the image forming apparatus of FIG. 1.

FIG. 9 is a schematic structure of a power transmission mechanism 200 from a document pickup motor 101. FIG. 10 is a schematic structure of a power transmission mechanism 201, which serves as a first drive unit, including the document feed motor 102 serving as a first heater. FIG. 11 is a schematic structure of a power transmission mechanism 202, which serves as a second drive unit, including the document read motor 103 serving as a second heater. FIG. 12 is a schematic structure of a power transmission mechanism 203, which serves as a third drive unit, including the document switchback motor 104 serving as a third heater.

In the power transmission mechanism 200 shown in FIG. 9, a pulley 121 that is connected to the document pickup motor 101 is connected via a timing belt 122 to a pulley 123. When the pulley 123 is rotated by the document feed motor 102, the rotation force may be transmitted from the pulley 123 to a pulley 124.

The pulley 124 is connected to a document feed cam 126 via a pulley 125. When the document pickup motor 101 is rotated in a normal direction, the pulley 124 rotates the document feed cam 126 in a counterclockwise direction in FIG. 9 to move the document pickup roller 31 to its home position or a position to which the document pickup roller 31 retreats from the original document stack DS.

When the document pickup motor 101 is driven in a reverse direction, the pulley 124 rotates the document feed cam 126 in a clockwise direction in FIG. 9 to move the document pickup roller 31 to its contact position or a position to which the document pickup roller 31 contacts the original document stack DS.

The pulley 124 is connected to a stopper cam 129 via pulleys 127 and 128. The document stopper 28 is controlled to move between the contact position and home position according to the direction of rotations of the stopper cam 129.

In the power transmission mechanism 201 shown in FIG. 10, a pulley 131 that is connected to the document feed motor 102 is connected via a timing belt 132 to a pulley 133 that is connected to a pulley 134.

The pulley 134 is connected to a pulley 147 via pulleys 135, 136, 144, 145, and 146. The pulley 147 is connected via a pulley 149 to a pulley 150. The pulley 150 is connected via a timing belt 151 to a pulley 152. The pulley 152 is connected to a pickup pulley 153 that is connected to the document pickup roller 31.

With the above-described structure, when the document feed motor 102 is rotated in a normal direction, which is in a clockwise direction in FIG. 10, the drive force is transmitted via the pulley 131, the timing belt 132, the pulleys 133, 134, 135, 136, 144, 145, 146, 147, 149, and 150, the timing belt 151, and the pickup pulley 153. Accordingly, the document pickup roller 31 is rotated in a clockwise direction in FIG. 10, so as to separate an original document on top of a stack of original documents accumulated on the original document stack DS.

Further, the pulley 147 is connected to a feed belt drive pulley 148 that drives the drive roller 32*a* of the document feeding belt 32. When the document feed motor 102 is rotated in a normal direction, which is in a clockwise direction in FIG. 10, the pulley 148 is rotated in a counterclockwise direction to move the document feeding belt 32 rotating in a direction to feed the original document stack DS.

The pulleys 134, 136, and 144 each includes a one-way clutch therein so as to transmit only the driving force in a clockwise direction of the document feed motor 102 to the pickup pulley 153 and the feed belt drive pulley 148.

Further, the pulley 135 is connected via pulleys 137, 154, 155, 156, and 157 to a reverse roller pulley 158 that rotates the reverse roller 33. When the document feed motor 102 rotates in a clockwise direction in FIG. 10, the reverse roller 33 is rotated in a clockwise direction in FIG. 10 via the pulleys 137, 154, 155, 156, and 157 so as to be rotated to separate an original document from the original document stack DS.

The pulley 137 includes a one-way clutch therein so as to transmit only the driving force in a clockwise direction of the document feed motor 102 to rotate the reverse roller 33.

The pulley 133 is connected to a pulley 139. The pulley 139 is connected to a pulley 138 that is coaxially connected to the pulleys 137 and 154 and is also connected to a pulley 140.

The pulley 140 is connected via pulleys 141 and 142 to a pull-out drive roller pulley 143 that is connected to the pull-out drive roller 36*a*.

With the above-described structure, when the document feed motor 102 is reversely rotated in a counterclockwise direction in FIG. 10, the pulley 140 is rotated in a counterclockwise direction in FIG. 10. This rotation of the pulley 140 drives the pull-out drive roller pulley 143 in a counterclockwise direction in FIG. 10 via the pulleys 142 and 141. Accordingly, the pair of pull-out rollers 36 is caused to transfer an original document to the scanning position 80.

In the power transmission mechanism 202 as shown in FIG. 11, a pulley 161 that is connected to the document read motor 103 is connected via a timing belt 162 to a pulley 163. The pulley 163 is connected to a pulley 164.

The pulley 164 is connected via a timing belt 165 to pulleys 166 and 167. The pulley 167 is connected to a read inlet roller pulley 168 to rotate the read inlet drive roller 37*a*. With the above-described structure, when the document read motor 103 is rotated in a normal direction, which is in a clockwise direction in FIG. 11, the read inlet driven roller 37*b* is rotated via the pulley 161, the timing belt 162, the pulleys 163 and 164, the timing belt 165, the pulleys 166 and 167, and the read inlet roller pulley 168 in a clockwise direction in FIG. 11, which is a document travel direction.

The pulley 167 includes a one-way clutch therein to transmit only the driving force in a clockwise direction of the document read motor 103 to the read inlet roller pulley 168.

The read inlet roller pulley 168 is connected to a pulley 169, which is connected via a timing belt 174 to a read outlet roller pulley 175.

The read outlet roller pulley 175 is connected via a read outlet drive roller pulley 176 to the read outlet drive roller 40*a* of the pair of read outlet rollers 40. The read outlet drive roller 40*a* rotates in a counterclockwise direction in FIG. 11, which is the document travel direction, along with the rotation in a counterclockwise direction of the read outlet roller pulley 175.

Further, the timing belt 174 is connected to a sheet discharging roller pulley 179. The sheet discharging roller pulley 179 is connected via a discharge drive roller pulley 180 to the discharge drive roller 42*a* of the document discharging roller set 42. The discharge drive roller 42*a* rotates in a clockwise direction in FIG. 11, which is the document travel direction, along with the rotation in a counterclockwise direction of the sheet discharging roller pulley 179.

The timing belt 174 is connected to pulleys 177 and 178, which are held in contact with the timing belt 174 to provide a constant extension force to the timing belt 174 so as to move the timing belt 174 to rotate.

Further, the pulley 169 is connected via a tension belt 170 to a pulley 171 of a jam recovery dial 172. The jam recovery dial 172 is provided for an operator to use when the operator removes a jammed paper or jammed papers from the document transfer path. When the jam recovery dial 172 is turned, the driving force is transmitted to the pulley 169 via the tension belt 170. When the pulley 169 moves the timing belt 174 to rotate, the jammed paper(s) can be removed. The tension belt 170 is held in contact with a pulley 173.

In the power transmission mechanism 203 as shown in FIG. 12, a pulley 191 that is connected to the document switchback motor 104 is connected via a timing belt 192 to a pulley 193. When the document switchback motor 104 rotates in either of a normal direction and a reverse direction, the pulley 191 rotates the switchback roller drive roller 45*a* of the pair of switchback rollers 45 in either of a normal direction and a reverse direction, respectively, via a switchback roller drive roller pulley 194. Further, the switchback roller driven roller 45*b* of the pair of switchback rollers 45 is rotatably held in contact with the switchback roller drive roller 45*a*.

Referring again to FIG. 1, the copier main body 21*a* of the copier 21 further includes the scanner 81 serving as an image reader, a writing device 82, and a photoconductive drum 83. Image data that has read by the scanner 81 may be exposed by the writing device 82 to the photoconductive drum 83.

The scanner 81 of FIG. 1 includes a light source 81*a*, a first mirror 81*b*, a second mirror 81*c*, a third mirror 81*d*, a lens 81*e*, and a charge-coupled device image sensor or CCD image sensor 81*f*, which are image forming components.

The light source 81*a* may illuminate an original document placed on the contact glass 22*a* or the slit glass 22*b*.

The first mirror 81*b*, the second mirror 81*c*, and the third mirror 81*d* may respectively reflect light reflected by the original document.

The lens 81*e* may form the light reflected by the third mirror 81*d* to the CCD image sensor 81*f*.

The CCD image sensor 81*f* may convert the light formed as image by the lens 81*e* into an electrical signal.

The light source 81*a* and the first mirror 81*b* are mounted on a first moving member 81*g*, and the second mirror 81*c* and the third mirror 81*d* are mounted on a second moving member 81*h*. The first moving member 81*g* and the second moving member 81*h* that form a moving mechanism 81*j* may move along the contact glass 22*a* and the slit glass 22*b*, which is in a horizontal direction in FIG. 1.

When reading or scanning an original document that is placed on the contact glass 22*a*, the moving mechanism 81*j* including the first moving member 81*g* and the second moving member 81*h* may be moved or slid under the contact glass 22*a* in the left and right directions or horizontal direction in FIG. 1.

When reading or scanning an original document that is passing over the slit glass 22*b*, the first moving member 81*g* and the second moving member 81*h* forming the moving mechanism 81*j* may be stopped under the slit glass 22*b*.

The writing device 82 may emit a laser light beam that is modulated according to the image data read by the scanner 81, and expose the charged surface of the photoconductive drum 83 with the laser light beam.

Various image forming components and units may be arranged around the photoconductive drum 83, which is also one of the image forming components and units. These image forming components and units are, for example, a developing device 86, a transfer belt 87, a cleaning device 88, a charging device, not shown, and a discharging device, not shown.

The charging device may charge the surface of the photoconductive drum 83 to a constant potential, by a positive corona discharge in the dark that is controlled by a grid.

The writing device 82 may emit a laser diode including image data onto the surface of the photoconductive drum 83 that is charged to a given potential, and remove the negative charge on the surface of the photoconductive drum 83, so as to form an electrostatic latent image.

The developing device 86 may adhere negatively charged toner onto an electric-charge-discharged portion on the surface of the photoconductive drum 83 to develop a visible toner image.

The transfer belt 87 that is applied with a positive bias may transfer the visible toner image that is negatively charged onto a transfer sheet serving as a recording medium and convey the transfer sheet having the visible toner image thereon.

The cleaning device 88 may include a cleaning blade, not shown, to scrape and remove residual toner remaining on the surface of the photoconductive drum 83.

The discharging device may remove residual charge from the surface of the photoconductive drum 83 by illuminating light-emitting diodes or LEDs so as to cause the photoconductive drum 83 to be ready for a subsequent image forming operation.

The transfer sheet having the visible toner image formed as described above may be transferred to a fixing device 90, by which the visible toner image may be fixed onto the transfer sheet.

In addition, the copier main body 21*a* of the copier 21 of FIG. 1 includes a plurality of sheet cassettes 91, 92, 93, 94, and 95, in which respective transfer sheets TS1, TS2, TS3, TS4, and TS5 having various sizes are accommodated.

The transfer sheets TS1, TS2, TS3, TS4, and TS5 accommodated in the plurality of sheet cassettes 91, 92, 93, 94, and 95, respectively, may be picked up and fed to a sheet transfer path by pickup rollers 91*a*, 92*a*, 93*a*, 94*a*, and 95*a*, respectively. The transfer sheets TS1, TS2, TS3, TS4, and TS5 may then be separated by sheet feeding rollers 91*b*, 92*b*, 93*b*, 94*b*, and 95*b*, rotating in a sheet travel direction, and reverse rollers 91*c*, 92*c*, 93*c*, 94*c*, and 95*c*, being held in sliding contact with the sheet feeding rollers 91*b*, 92*b*, 93*b*, 94*b*, and 95*b*, respectively, and rotating in a separating direction.

After the separation, the transfer sheets TS1, TS2, TS3, TS4, and TS5 may be transferred to a pair of registration rollers 98 via a pair of relay rollers 96 and 97. The transfer sheets TS1, TS2, TS3, TS4, and TS5 may be fed and stopped at the pair of registration rollers 98. After a reference time, the transfer sheets TS1, TS2, TS3, TS4, and TS5 may be conveyed to the sheet transfer path formed between the photoconductive drum 83 and the transfer belt 87.

Next, referring to FIGS. 13 through 16, a description is given of a cooling mechanism of the image reading system 20.

Figure 13:
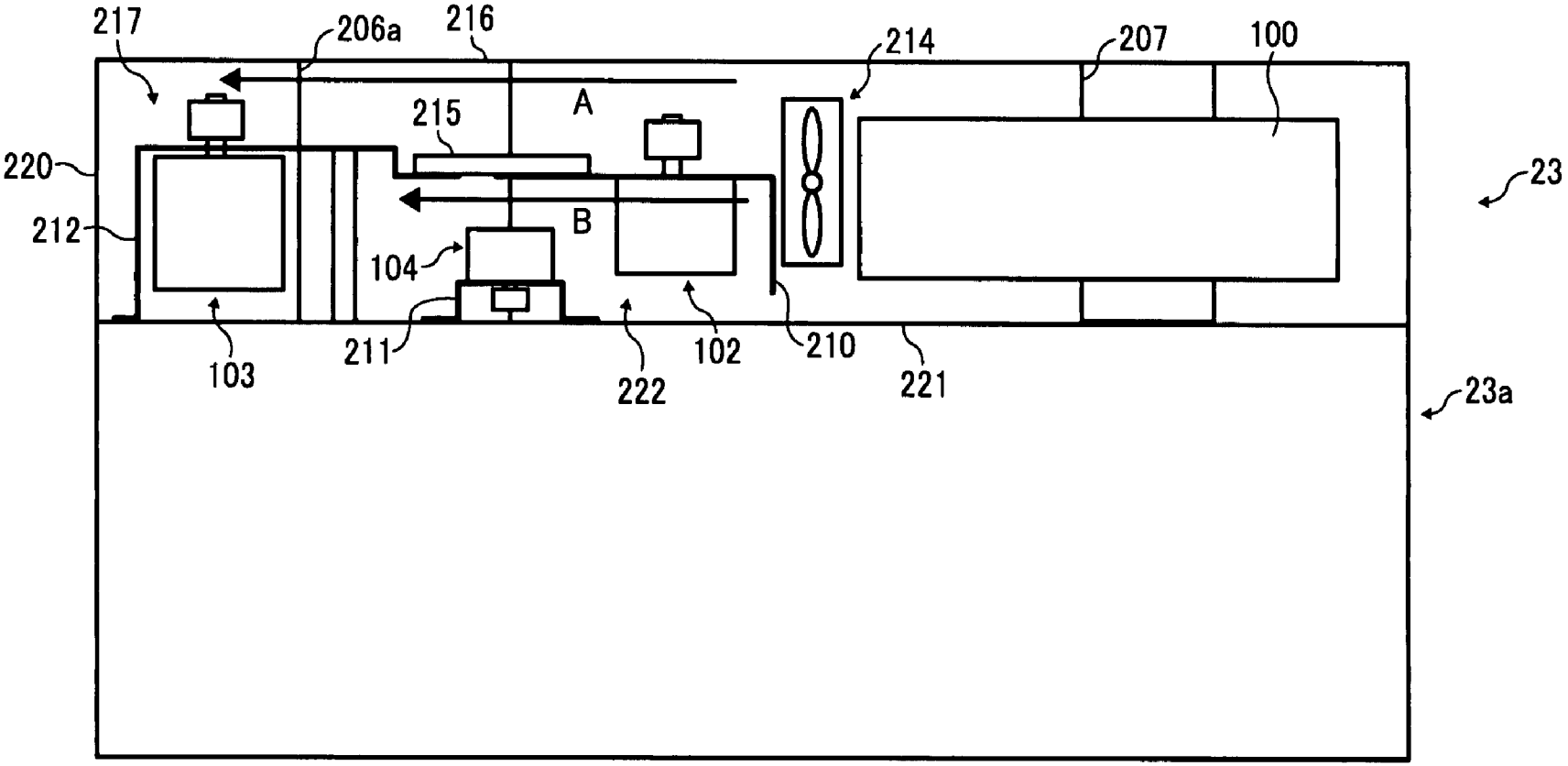
FIG. 13 is a schematic top view of the automatic document feeder of FIG. 2.
Figure 14:
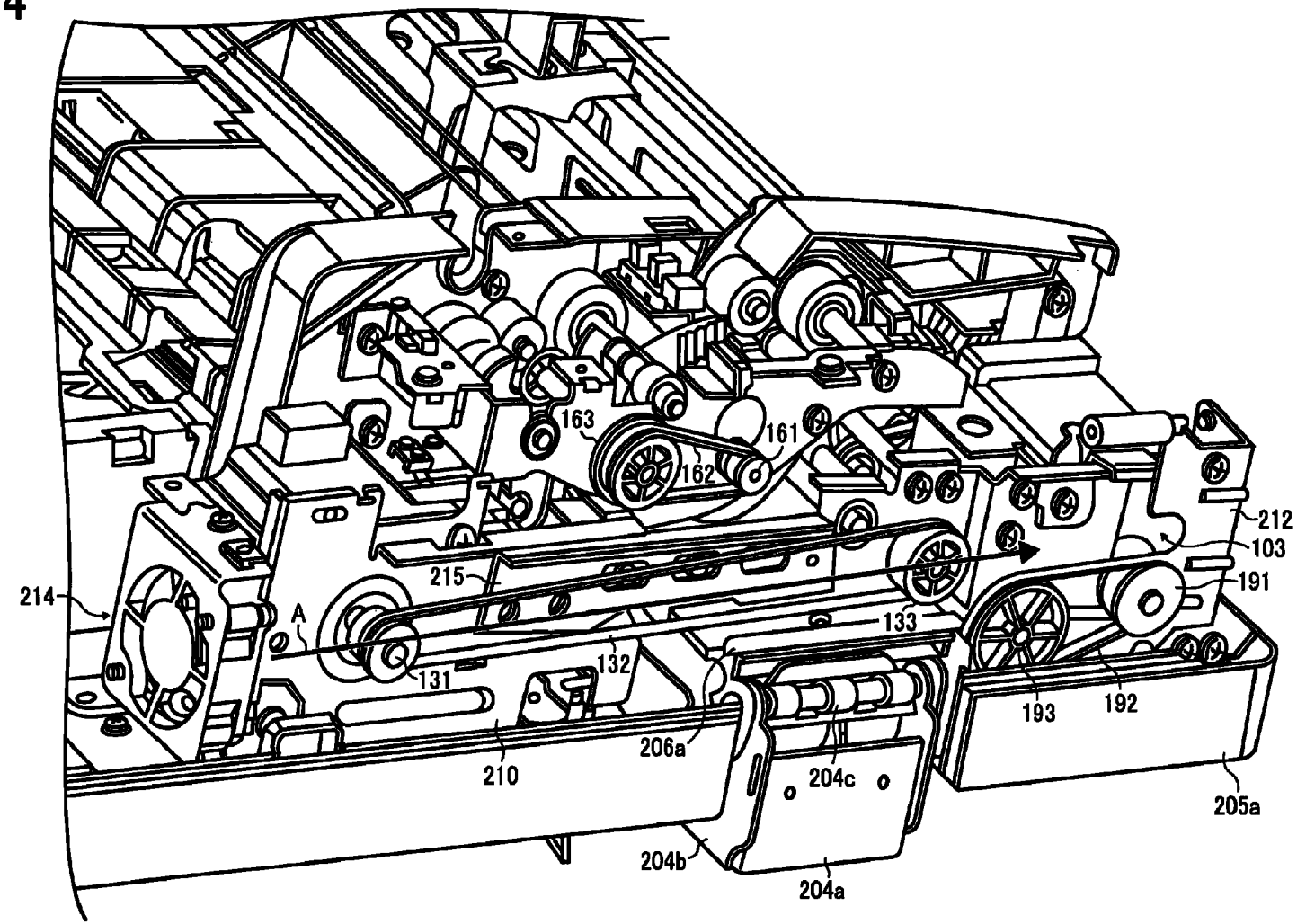
FIG. 14 is a perspective view of a main part of the automatic document feeder of FIG. 2, viewed from the back side thereof.
Figure 15:
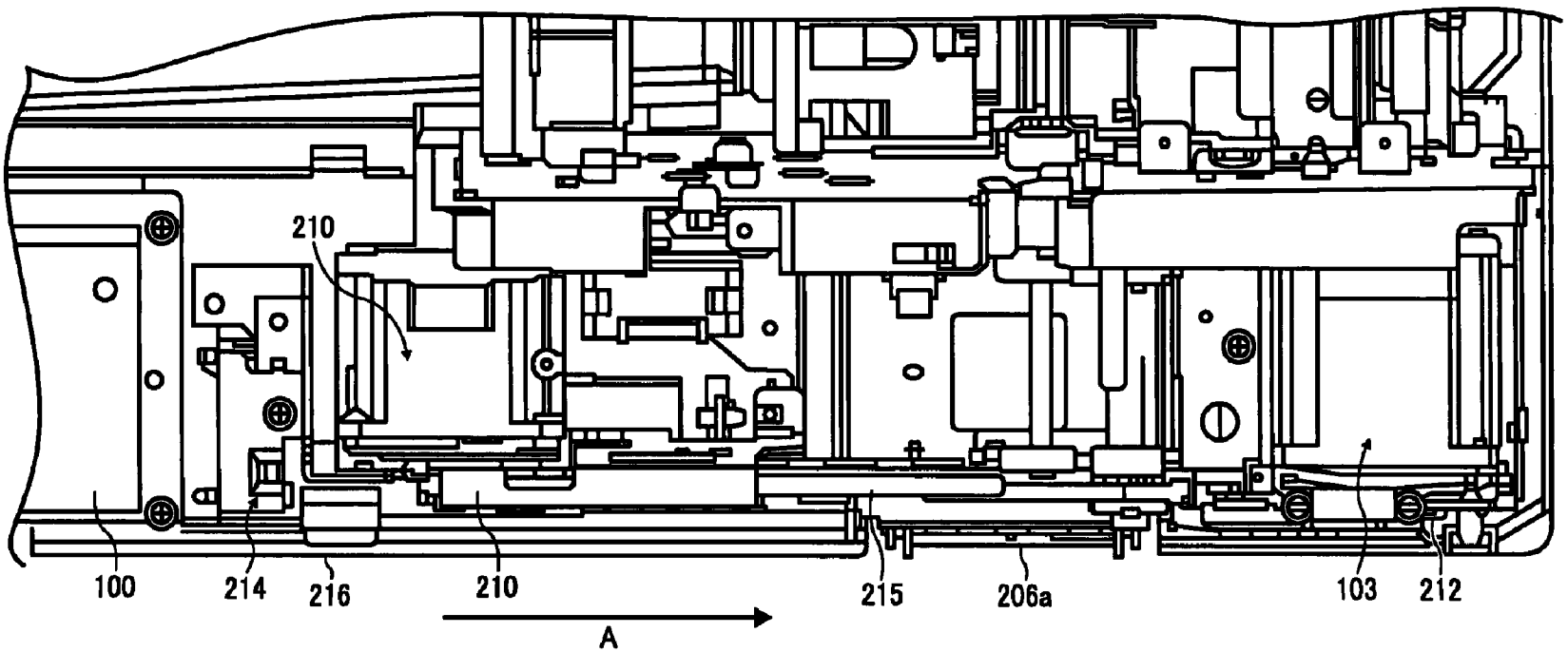
FIG. 15 is a schematic top view of the automatic document feeder of FIG. 2, seen upside down of FIG. 13.
Figure 16:
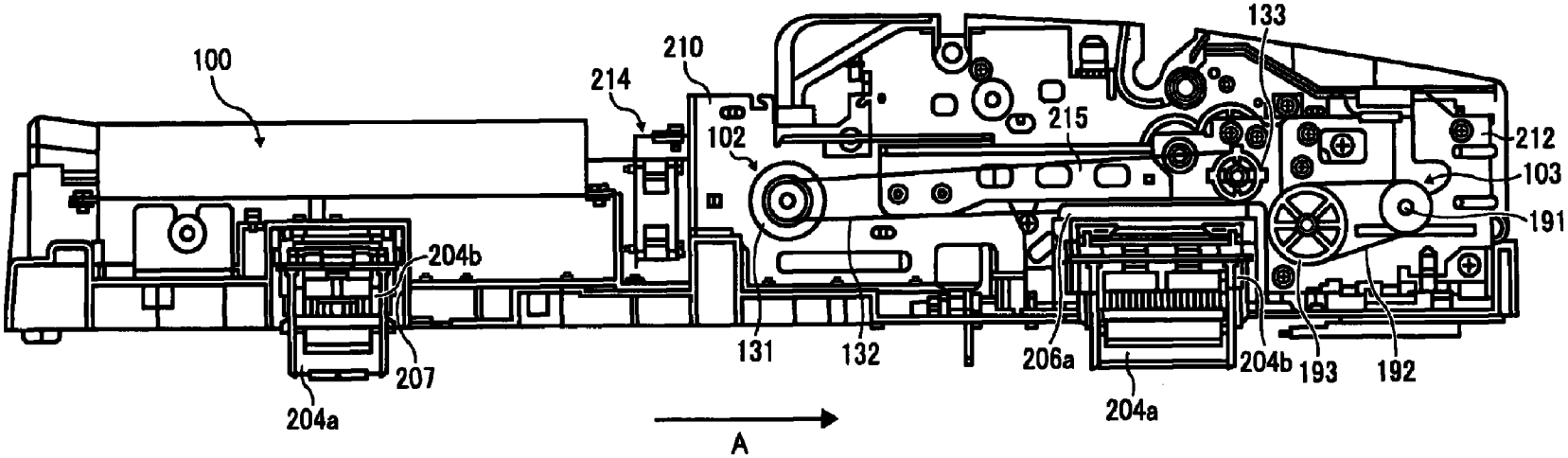
FIG. 16 is a rear view of the automatic document feeder of FIG. 2, seen from the back side thereof.

FIG. 13 is a top view of the ADF 23, illustrating the lower part as a front or near side of the ADF 23 and the upper part as a back or far side thereof. FIG. 14 is a perspective view of a main part of the ADF 23, viewed from the back side thereof. FIG. 15 is a schematic top view of the ADF 23, seen upside down of FIG. 13. FIG. 16 is a rear view of the ADF 23, seen from the back side thereof.

In FIGS. 13 through 16, the document feed motor 102 is supported by a metallic motor bracket 210, which is fixedly mounted on the ADF main body 23*a* of the ADF 23. The document read motor 103 is supported by a metallic motor bracket 211, which is fixedly mounted on the ADF main body 23*a* of the ADF 23. The switchback motor 104 is supported by a metallic motor bracket 212, which is fixedly mounted on the ADF main body 23*a* of the ADF 23.

Since FIG. 13 is a schematic view, the power transmission mechanisms 201, 202, and 203 are not shown.

As shown in FIG. 13, a fan motor 214 is disposed at the right-hand side of the document feed motor 102. The fan motor 214 serves as a cooling member, and is arranged in substantially series with the document feed motor 102, the switchback motor 104, and the document read motor 103. A motor driver, not shown, which is controlled by the ADF controller 100, drives the fan motor 214 to supply air as coolant along the alignment of the document feed motor 102, the switchback motor 104, and the document read motor 103. Air generated by the fan motor 214 is supplied from a center part to a left-hand side of the ADF main body 23*a* in FIG. 13, in directions as indicated by arrows A and B of FIG. 13 so that the document feed motor 102, the switchback motor 104, and the document read motor 103 can be cooled in this order. The ADF controller 100 is disposed on the right-hand side of the fan motor 214, and is kept at low temperature since the ADF controller 100 does not include a heat source.

Arrow A is also shown in FIGS. 14 and 15 to indicate a direction of air flow from the fan motor 214. In this example embodiment, the ADF controller 100 serves as a drive controller.

When air is supplied from the fan motor 214, in general, the document feed motor 102 arranged at a nearest position from the fan motor 214 can be cooled down most and the switch back motor 104 arranged at a farthest position which is an extreme downstream side from the fan motor 214 may be cooled least. To avoid such an inconvenient condition, the example embodiment of the present invention includes a configuration to effectively supply air from the fan motor 214 and cool down the document read motor 103.

For example, the motor bracket 210 and the motor bracket 212 are connected via a metallic bracket link 215. The ADF 23 further includes paths 217 and 222 to guide the flow of air from the fan motor 214 in the directions as indicated by arrows A and B, respectively. The path 217 is provided to a space surrounded by the motor bracket 210, the motor bracket 212, the bracket link 215, and a rear wall 216 serving as a wall plate of an upper cover 205*b* of the ADF main body 23*a*. The path 222 is provided to a space surrounded by the motor bracket 210, the motor bracket 212, the bracket link 215, and a center wall 221 serving as a wall plate of the upper cover 205*b* of the ADF main body 23*a*. With this configuration, the air flowing from the fan motor 214 through the paths 217 and 222 can be guided effectively to the document read motor 103 disposed at an extreme downstream side from the fan motor 214 to cool down. Especially, the document feed motor 102, the switchback motor 104, and the document read motor 103 are not arranged along the path 217, the air flowing from the fan motor 214 through the path 217 can travel, without any obstacles, via the motor brackets 210 and 212 to cool the document feed motor 102, the switchback motor 104, and the document read motor 103.

In the example embodiment of the present patent application, the motor brackets 210 and 212 and the bracket link 215 form a supporting member, and the motor brackets 210 and 212; the bracket link 215, and the rear wall 216 and the center wall 221 of the upper cover 205*b* of the ADF main body 23*a* form a guide member.

Figure 17:
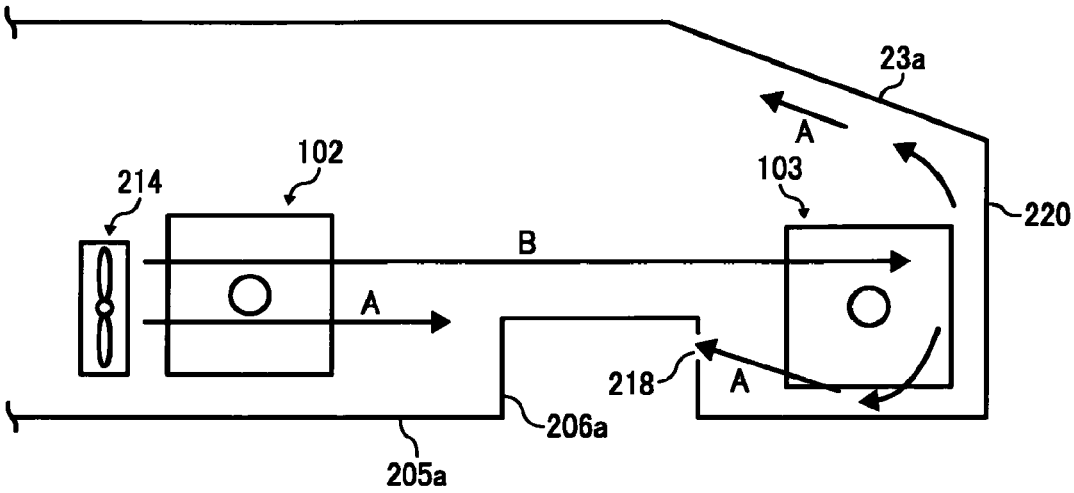
FIG. 17 is a schematic diagram showing air flow inside the automatic document feeder.

As previously described, the ADF 23 includes the outlet 218, and the inlet 219. The outlet 218 is disposed upstream from the document read motor 103 disposed at a most downstream side of the air flow in the direction indicated as arrow A, as shown in FIG. 17. The inlet 219 is disposed at a space formed between the attachment bracket 207 and the upper cover 205*b* and at an upstream side of the air flow. Air taken from outside through the inlet 219 and supplied by the fan motor 214 travels to the document feed motor 102, the switchback motor 104, and the document read motor 103 in this order, and collides with a side wall 220 of the upper cover 205*b* to be discharged out.

After a given number (20 sheets, for example) of original documents has been separated and fed by the document feeding belt 32 and the reverse roller 33 from the original document stack DS placed on the original document table 24, the ADF controller 100 starts driving the fan motor 214. Then, after a given period of time (20 seconds, for example) has passed from a completion of conveyance of the original documents, the ADF controller 100 stops driving the fan motor 214.

Next, operations of transferring the original documents are described, referring to flowcharts shown in FIG. 19 through FIG. 27.

The flowcharts of FIGS. 19 through 27 show a document transfer control operation that is controlled by the ADF controller 100 communicating with the main body controller 111.

Figure 19:
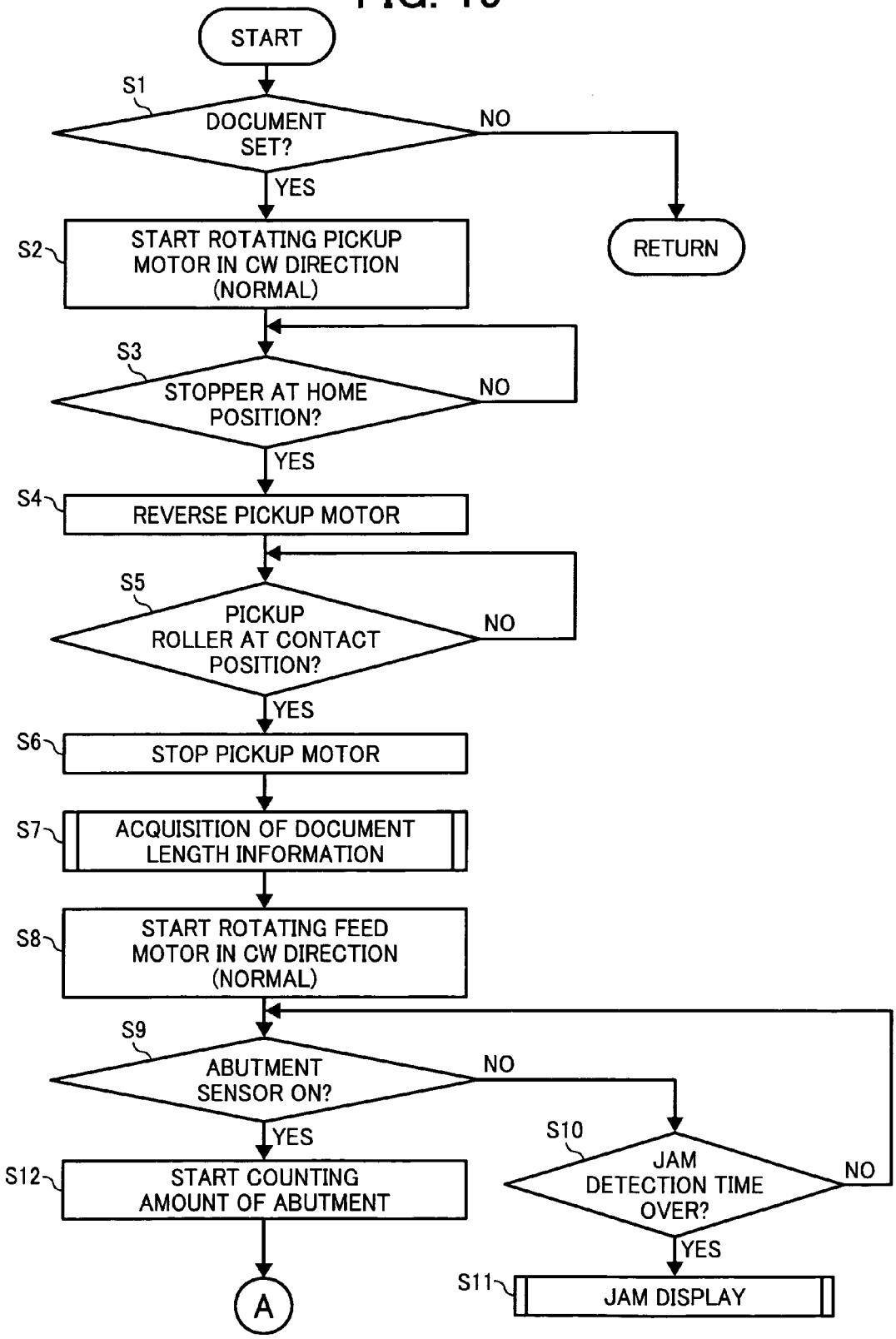
FIG. 19 is a flowchart (according to an example embodiment of the present patent application) of a document transfer control operation performed by the image forming apparatus of FIG. 1.

In step S1 in the flowchart of FIG. 19, the ADF controller 100 determines whether an original document stack DS is set on the document setting table 24, based on the detection results determined by the document length detection sensors 25, 26, and 27.

When a print key on the control panel 108 is pressed, the main body controller 111 sends the document pickup signal to the ADF controller 100 via the I/F 107.

In step S2, the ADF controller 100 drives the document pickup motor 101 to rotate in a normal direction, which is in a clockwise direction. At this time, the document stopper 28 moves away from the leading edge of the original document stack DS.

Then, in step S3, the ADF controller 100 determines whether the document stopper 28 has moved to its home position, based on the detection result of the home position sensor 34.

When it is determined that the document stopper 28 has moved to its home position, the result of step S3 is YES, and the ADF controller 100 rotates the document pickup motor 101 in a reverse direction in step S4.

By contrast, when it is determined that the document stopper 28 has not moved to its home position, the result of step S3 is NO, and the ADF controller 100 repeats step S3 until it is determined that the document stopper 28 moves to its home position.

After step S4, the ADF controller 100 determines whether the document pickup roller 31 has moved to its contact position in step S5.

When it is determined that the document pickup roller 31 has not moved to its contact position, the result of step S5 is NO, and the ADF controller 100 repeats step S5 until the document pickup roller 31 moves to the contact position.

When it is determined that the document pickup roller 31 has moved to its contact position, the result of step S5 is YES, the ADF control 100 stops the document pickup motor 101 in step S6, obtains the length of the original document, based on the result detected by the document length detection sensors 25, 26, and 27 in step S7, and rotates the document feed motor 102 in a normal direction, which is in a clockwise direction in step S8.

With the above-described operation, after the document pickup roller 31 has separated an original document on top of the original document stack DS, the original document on top of the original document stack DS can be transferred by the document feeding belt 32 and the reverse roller 33.

After step S8, the ADF controller 100 determines, in step S9, whether the abutment sensor 35 has been turned on.

When it is determined that the abutment sensor 35 has not been turned on, the result of step S9 is NO, and the ADF controller 100 determines whether the jam detection time is over or not in step S10.

When it is determined that the jam detection time is not over, the result of step S10 is NO, and the ADF controller 100 repeats step S10 until the jam detection time is over.

When it is determined that the jam detection time is over, the result of step S10 is YES, and abutment sensor 35 has been turned on, the result of step S9 is YES, and the ADF controller 100 determines that a jam indicating that the original document is not abut against the nip portion of the pair of pull-out rollers 36 has occurred and displays a message on the display panel 48 to inform the occurrence of jam in step S11.

When it is determined that the abutment sensor 35 has been turned on, the result of step S9 is YES, and the ADF controller 100 counts the amount or length of abutment of the leading edge of the original document, in step S12. Specifically, the ADF controller 100 starts counting the drive pulses of the document feed motor 102 that correspond to a reference amount or length of X mm, which is set greater than the distance between the abutment sensor 35 and the pair of pull-out rollers 36.

Figure 20:
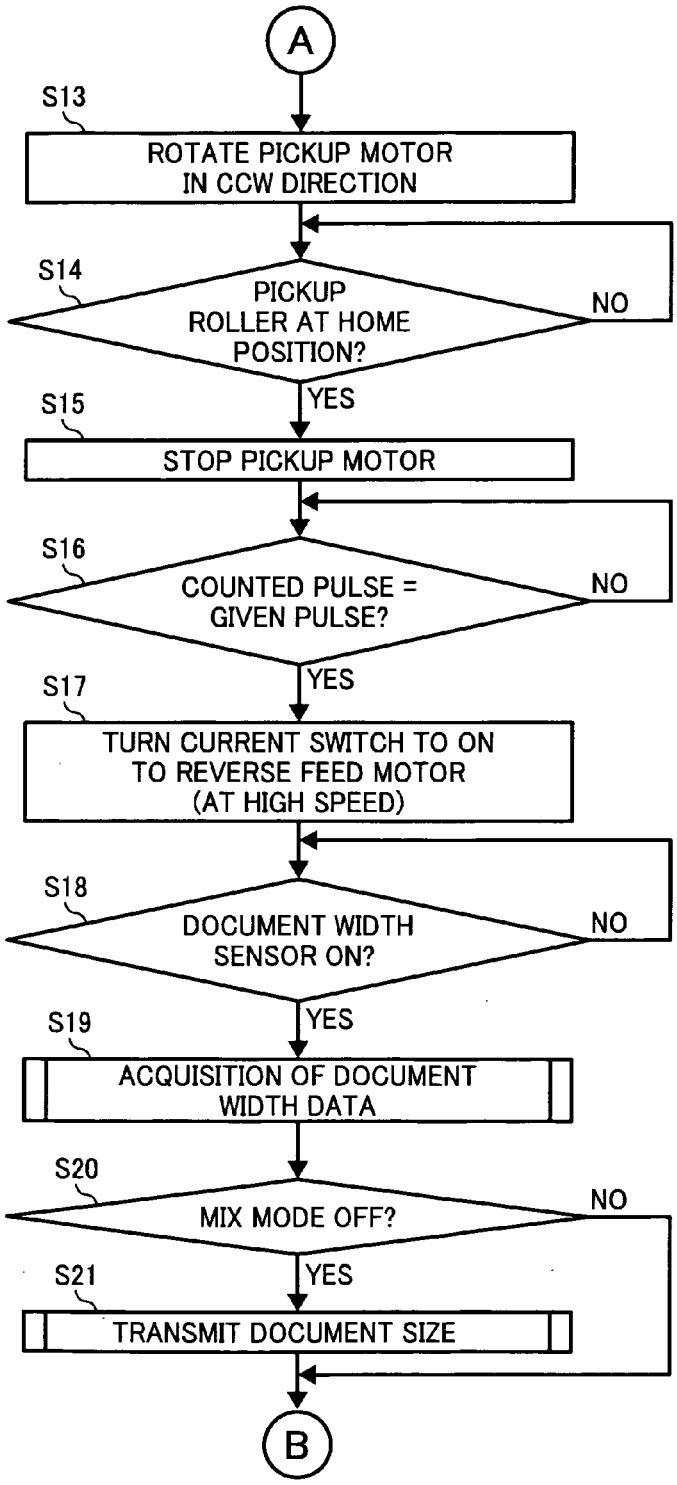
FIG. 20 is a flowchart (according to an example embodiment of the present patent application) continued from the flowchart shown in FIG. 19.

After step S12, the process proceeds to process A, where process A starts at step S13 in FIG. 20.

As shown in the flowchart of FIG. 20, the ADF controller 100 rotates the document pickup motor 101 in a reverse direction, which is a counterclockwise direction in step S13, and determines whether the document pickup roller 31 has moved to its home position in step S14.

When it is determined that the document pickup roller 31 has not moved to the home position, the result of step S14 is NO, and the ADF controller 100 repeats step S14 until the document pickup roller 31 moves to the home position.

When it is determined that the document pickup roller 31 has moved to the home position, the result of step S14 is YES, and the ADF controller stops the rotation of the document pickup motor 101 in step S15, and determines whether the number of counted pulses of the document feed motor 102 has reached the reference number of pulses that corresponds to the amount or length of abutment (X mm) in step S16.

When it is determined that the number of counted pulses of the document feed motor 102 has not reached the reference number of pulses, the result of step S16 is NO, and the ADF controller 100 repeats step S16 until the number of counted pulses of the document feed motor 102 reaches the reference number of pulses.

When it is determined that the number of counted pulses of the document feed motor 102 has reached the reference number of pulses, the result of step S16 is YES, and the ADF controller 100 turns the switch of the current of the document feed motor 102 to ON to drive the document feed motor 102 to rotate at high speed in step S17.

When the document feed motor 102 is rotated in a reverse direction, the pair of pull-out rollers 36 is driven whereas the one-way clutch of the pulley 140 prevents the transmission of the driving force to the document pickup roller 31 and the document feeding belt 32. Therefore, the original document is conveyed by the pair of pull-out rollers 36.

In step S18, the ADF controller 100 determines whether the document width detection sensors 38 have been turned on.

When it is determined that the document width detection sensors 38 have not been turned on, the result of step S18 is NO, and the ADF controller 100 repeats step S18 until the document width detection sensors 38 is turned on.

When it is determined that the document width detection sensors 38 have been turned on, the result of step S18 is YES, and the ADF controller 100 obtains, in step S19, information of the width of the original document based on the detection result determined by the document width detection sensors 38.

According to the above-described result, the ADF controller 100 can obtain information of the size of the original document stack DS accumulated on the document setting table 24, based on the combination of the length information provided by the document length detection sensors 25, 26, and 27 and the width information provided by the document width detection sensors 38.

At this time, the original document is conveyed toward the scanning position 80 while being sandwiched by the pair of pull-out rollers 36 and the pair of read inlet rollers 37. The transfer speed of the original document is set to high speed, which can reduce the processing time to transfer the original document to the scanning position 80. Specially, when transferring the second original document or after, the document transfer in high speed can reduce the intervals between the preceding original document and the following document, which can enhance the productivity of print images.

After step S19, the ADF controller 100 determines whether the mix mode has been turned off in step S20.

When it is determined that the mix mode has been turned off, the result of step S20 is YES, and the ADF controller 100 sends the size information of the original document stack DS accumulated on the document setting table 24, to the main body controller 111 in step S21.

Figure 21:
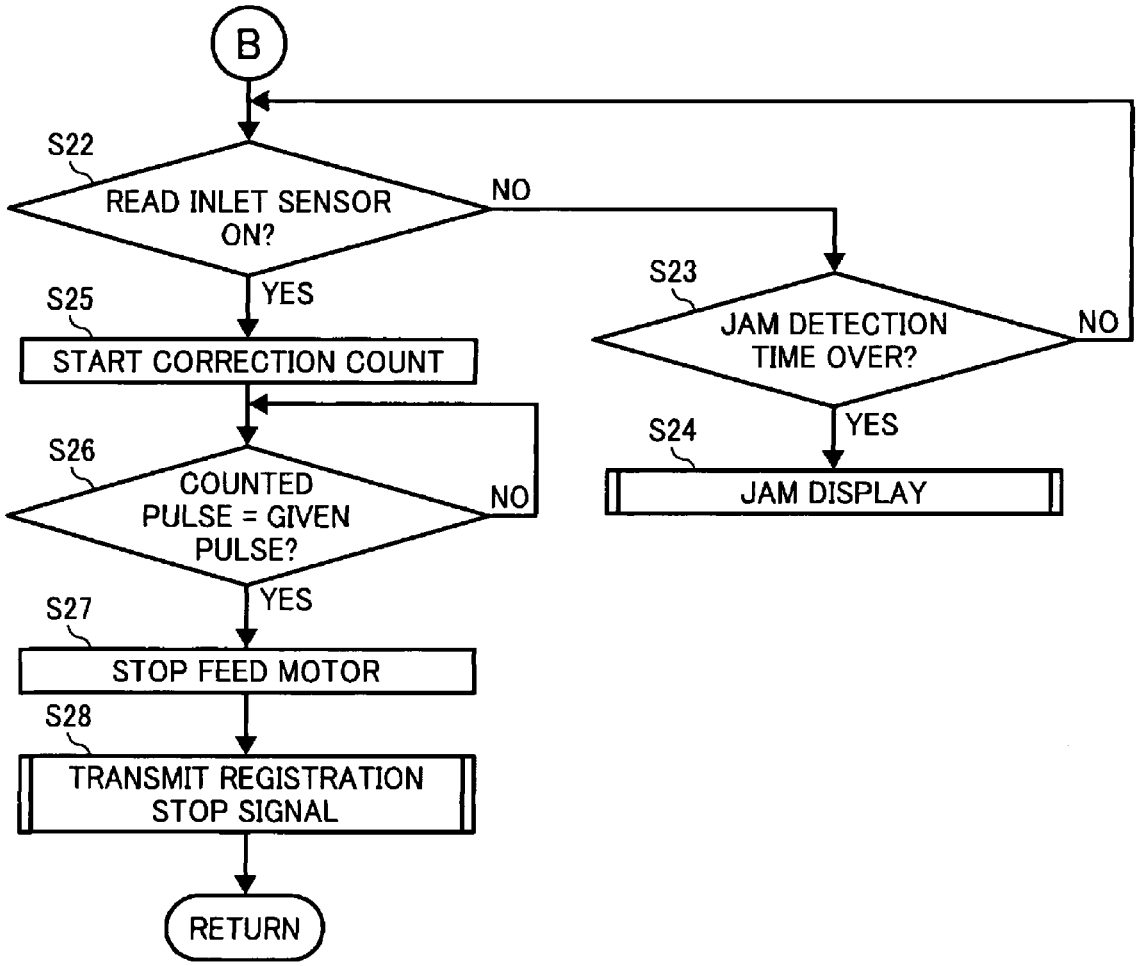
FIG. 21 is a flowchart (according to an example embodiment of the present patent application) continued from the flowchart shown in FIG. 20.

When it is determined that the mix mode has not been turned off, the result of step S20 is NO, and the process proceeds to process B, where process B starts at step S22 in FIG. 21.

After step S22, the ADF controller 100 determines whether the read inlet sensor 39 has been turned on to detect the leading edge of the original document.

When it is determined that the read inlet sensor 39 has been not been turned on to detect the leading edge of the original document, the result of step S24 is NO, and the ADF controller 100 determines whether the jam detection time has been over in step S23.

When it is determined that the jam detection time has not been over, the result of step S23 is NO, and the process returns to step S22.

When it is determined that the jam detection time has been over, the result of step S23 is YES, and the ADF controller 100 determines that a jam indicating that the leading edge of the original document has not reached the read inlet sensor 39 has occurred and displays a message on the display panel 48 to inform the occurrence of the jam, in step S24.

On the other hand, when it is determined that the read inlet sensor 39 has been turned on, the result of step S22 is YES, and the ADF controller 100 starts the correction count of the amount or length of abutment of the leading edge of the original document, in step S25. Specifically, the ADF controller 100 starts counting the drive pulses of the document feed motor 102 that corresponds to a reference amount of Y mm, which is an amount greater than the distance between the read inlet sensor 39 and the pair of read inlet rollers 37.

After step S25, the ADF controller 100 determines whether the pulse count of the document feed motor 102 has reached the reference number of pulses that corresponds to the amount or length of abutment (Y mm) in step S26.

When it is determined that the pulse count of the document feed motor 102 has not reached the reference number of pulses, the result of step S26 is NO, and the ADF controller 100 repeats step S26 until the pulse count reaches the reference number of pulses.

When it is determined that the pulse count of the document feed motor 102 has reached the reference number of pulses, the result of step S26 is YES, and the ADF controller 100 causes the document feed motor 102 to stop in step S27, sends the registration stop signal to the main body controller 111 in step S28, and completes the transfer control of the original document to the scanning position 80 to return to the start of the operation for a next original document.

At the timing that the document feed motor 102 has reached the reference number of pulses, the original document is pressed contact to the pair of read inlet rollers 37 while being bowed with a reference amount. Under such condition, the skew caused by the bow with the reference amount is corrected.

Figure 22:
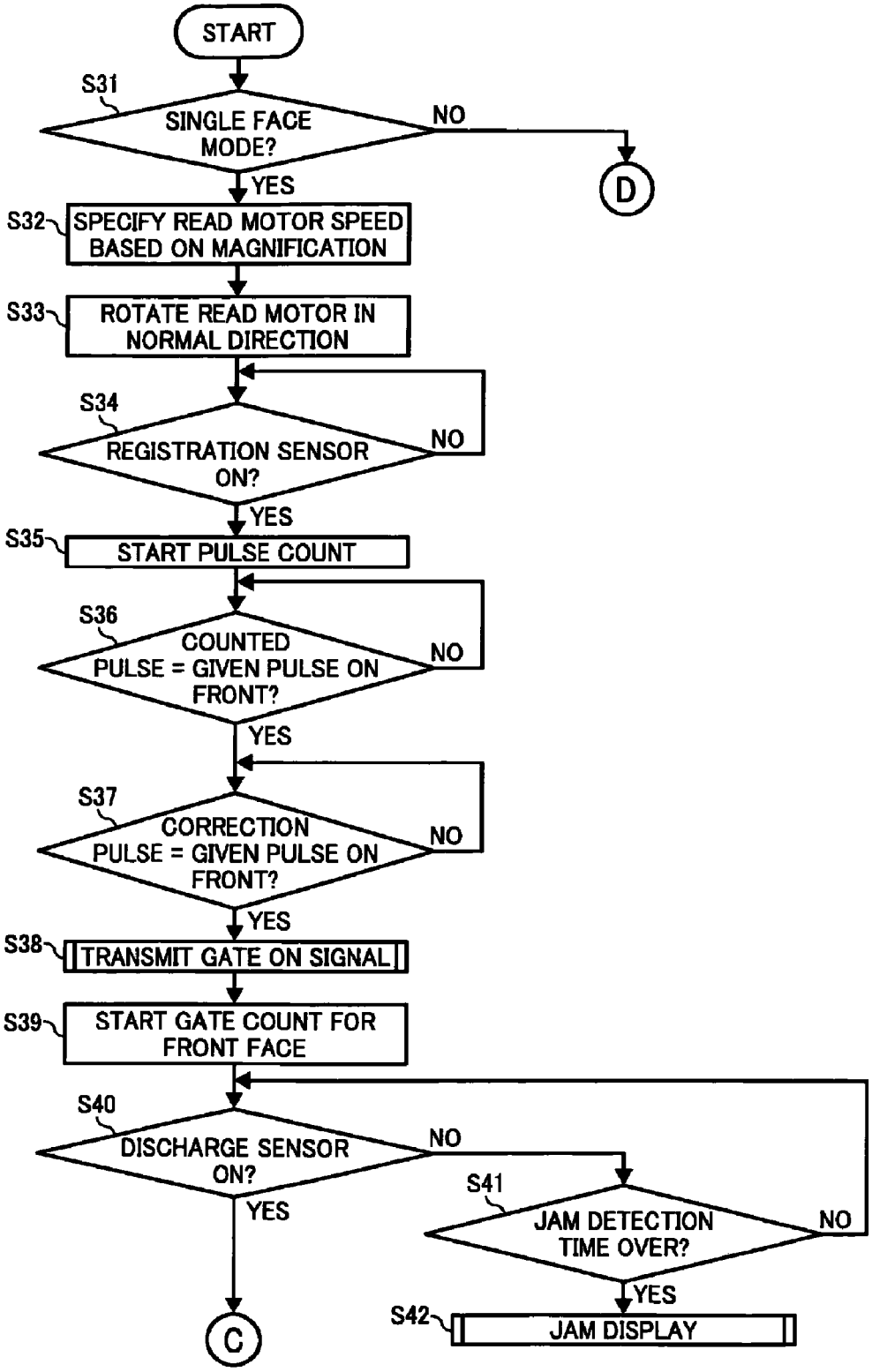
FIG. 22 is a flowchart of a transfer control operation (according to an example embodiment of the present patent application) when starting reading an original document.

The flowchart shown in FIG. 22 describes a flow of control operation of transferring an original document while reading the original document.

In the flowchart of FIG. 22, the ADF controller 100 determines whether the original document is in the single face mode or not in step S31.

Figure 24:
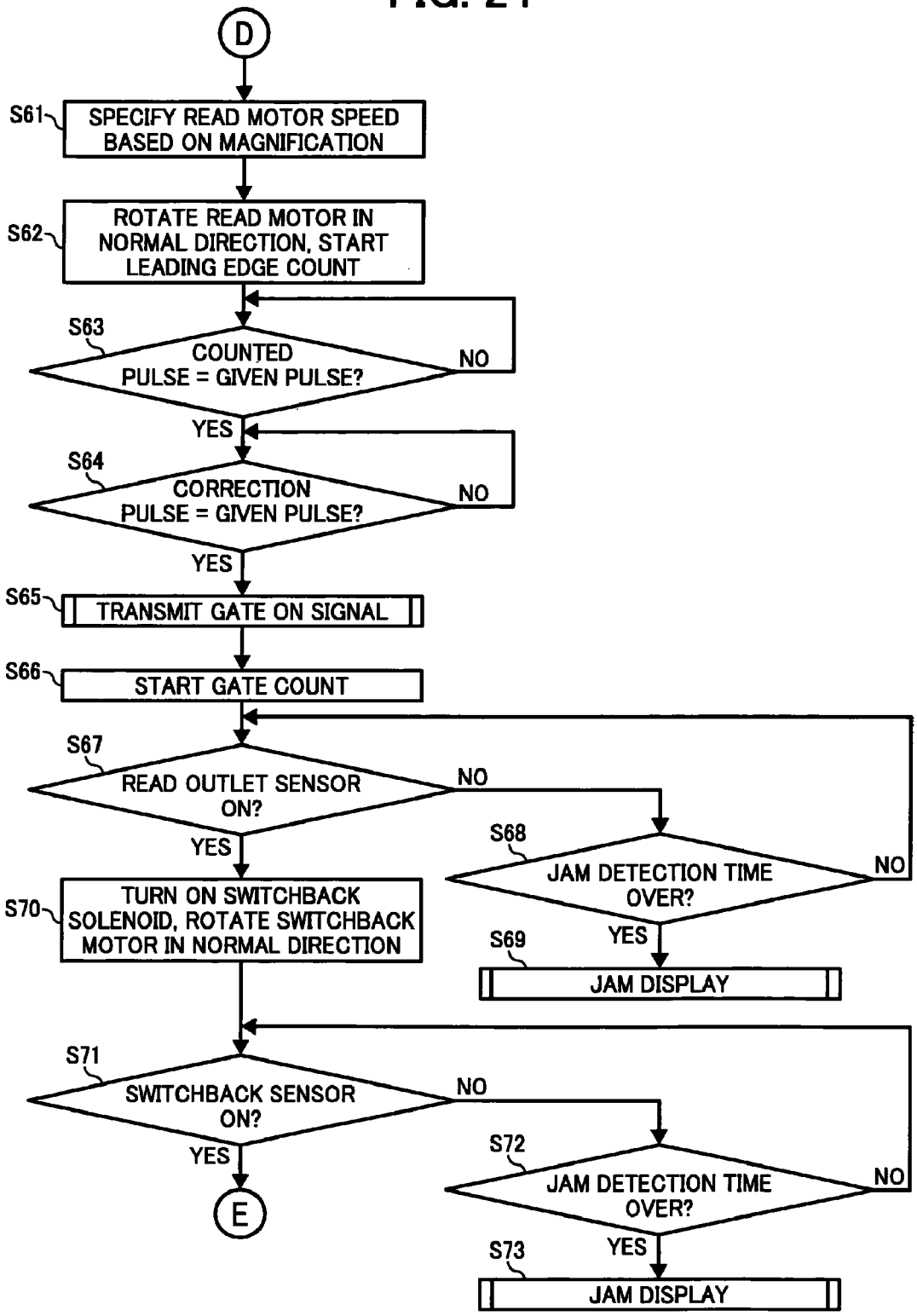
FIG. 24 is a flowchart (according to an example embodiment of the present patent application) continued from the flowchart shown in FIG. 23.

When it is determined that the original document is not in the single face mode, the result of step S31 is NO, and the process proceeds to process D, where process D starts at step S61 in FIG. 24. Details of the operation of step S61 will be described later.

When it is determined that the original document is in the single face mode, the result of step S31 is YES, the ADF controller 100 specifies the speed of the document read motor 103 based on the read scan magnification in step S32. Sequentially, the ADF controller 100 receives the read start signal from the main body controller 111, and starts to execute the scanning operation of the original document.

Specifically, the ADF controller 100 drives the document read motor 103 to rotate in a normal direction, in step S33, so as to rotate the pair of read inlet rollers 37 and the pair of read outlet rollers 40 at the transfer speed according to the read scan magnification.

After step S33, the ADF controller 100 determines whether the registration sensor 41 has been turned on to detect the leading edge of the original document in step S34.

When it is determined the registration sensor 41 has not been turned on to detect the leading edge of the original document, the result of step S34 is NO, and the ADF controller 100 repeats step S34 until the registration sensor 41 is turned on to detect the leading edge of the original document.

When it is determined that the registration sensor 41 has been turned on to detect the leading edge of the original document, the result of step S34 is YES, and ADF controller 100 starts counting the number of pulses of the document read motor 103 in step S35.

After step S35, the ADF controller 100 determines, in step S36, whether the number of counted pulses of the document read motor 103 has reached a reference number of pulses for the front face of the original document, which corresponds to the distance of the registration sensor 41 and the scanning position 80 on the slit glass 22*b*.

When it is determined that the number of counted pulses of the document read motor 103 has not reached a reference number of pulses for the front face of the original document, the result of step S36 is NO, and the ADF controller 100 repeats step S36 until the number of counted pulse counts of the document read motor 103 reaches a reference number of pulses for the front face of the original document.

When it is determined that the number of counted pulses of the document read motor 103 has reached a reference number of pulses for the front face of the original document, the result of step S36 is YES, and the ADF controller 100 determines, in step S37, whether the number of correction pulses that account for the slip ratio and so forth of the original document has reached a reference number of pulses for the front face of the original document.

When it is determined that the number of correction pulses has not reached a reference number of pulses for the front face of the original document, the result of step S37 is NO, and the ADF controller repeats step S37 until the number of correction pulses reaches a reference number of pulses for the front face of the original document.

When it is determined that the number of correction pulses has reached a reference number of pulses for the front face of the original document, the result of step S37 is YES, the ADF controller 100 sends the gate signal that indicates an image area in a sub-scanning direction, to the main body controller 111 at the timing that the leading edge of the original document reaches the scanning position 80 in step S38, starts counting the number of the gate counts for the front face of the original document in step S39, and determines whether the discharge sensor 50 has been turned on to detect the leading edge of the original document in step S40.

When it is determined that the discharge sensor 50 has not been turned on to detect the leading edge of the original document, the result of step S40 is NO, and the ADF controller 100 determines whether the jam detection time has been over or not in step S41.

When it is determined that the jam detection time has not been over, the result of step S41 is NO, and the process goes back to step S40.

When it is determined that the jam detection time has been over, the result of step S41 is YES, and the ADF controller 100 determines a jam indicating that the leading edge of the original document has not reached the discharge sensor 50 has occurred and displays a message on the display panel 48 to inform the occurrence of the jam in step S42.

Figure 23:
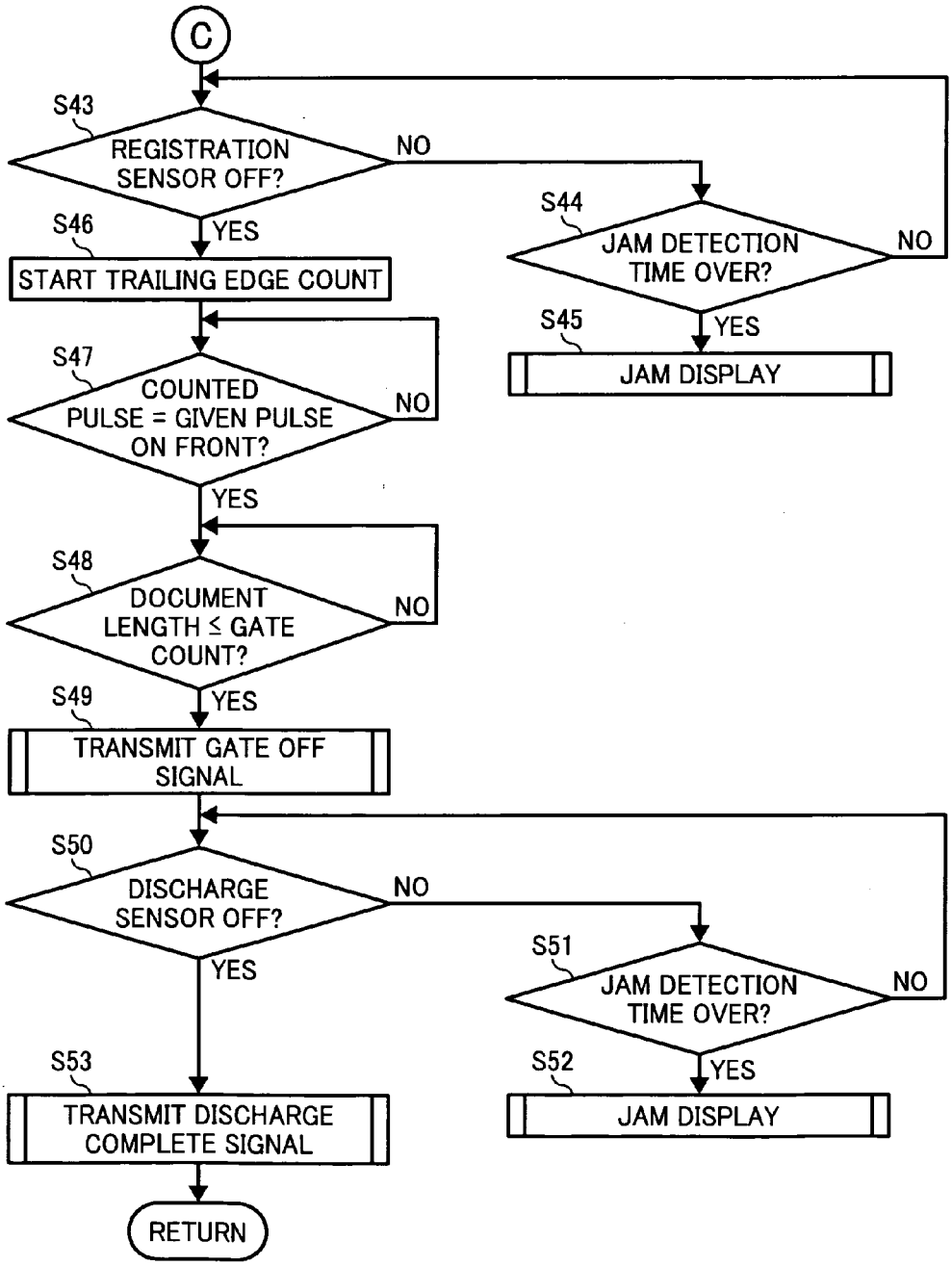
FIG. 23 is a flowchart (according to an example embodiment of the present patent application) continued from the flowchart shown in FIG. 22.

On the other hand, when it is determined that the discharge sensor 50 has been turned on to detect the leading edge of the original document, the result of step S40 is YES, the ADF controller 100 determines whether the registration sensor 41 has been turned off in process C starting at step S43, as shown in FIG. 23.

When it is determined that the registration sensor 41 has not been turned off, the result of step S43 is NO, and the ADF controller 100 determines whether the jam detection time has been over in step S44.

When it is determined that the jam detection time has not been over, the result of step S44 is NO, and the process returns to step S43.

When it is determined that the jam detection time has been over, the result of step S44 is YES, and the ADF controller 100 determines that a jam indicating that the original document has not reached the document discharging tray 43 has occurred and displays a message on the display panel 48 to inform the occurrence of the jam in step S45.

Further, when it is determined that the registration sensor 41 has been turned off, the result of step S43 is YES, and the ADF controller 100 starts the trailing edge count for counting the number of pulses of the document read motor 103 in step S46, and determines whether the number of counted pulses of the document read motor 103 has reached a reference number of pulses for the front face of the original document in step S47.

When it is determined that the number of counted pulses of the document read motor 103 has not reached the reference number of pulses for the front face of the original document, the result of step S47 is NO, and the ADF controller 100 repeats step S47 until the number of counted pulses of the document read motor 103 reaches a reference number of pulses for the front face of the original document.

When it is determined that the number of counted pulses of the document read motor 103 has reached a reference number of pulses for the front face of the original document, the result of step S47 is YES, and the ADF controller 100 determines whether the number of counted gate pulses is equal to or greater than the length of the original document, in step S48.

When it is determined that the number of counted gate pulses is smaller than the length of the original document, the result of step S48 is NO, and the ADF controller 100 repeats step S48 until the number of counted gate pulses becomes equal to or greater than the length of the original document.

When it is determined that the number of counted gate pulses is equal to or greater than the length of the original document, the result of step S48 is YES, and the ADF controller 100 sends the gate off signal that indicates the image area in the sub-scanning direction in step S49, and determines whether the discharge sensor 50 has been turned off in step S50.

When it is determined that the discharge sensor 50 has not been turned off, the result of step S50 is NO, and the ADF controller 100 determines whether the jam detection time has been over in step S51. When it is determined that the jam detection time has not been over, the result of step S51 is NO, and the process goes back to step S50.

When it is determined that the jam detection time has been over, the result of step S51 is YES, the ADF controller 100 determines that a jam indicating that the original document is not completely discharged has occurred and displays a message on the display panel 48 to inform the occurrence of the jam in step S52.

When it is determined that the discharge sensor 50 has been turned off, the result of step S50 is YES, the ADF controller 100 sends the discharge completion signal to the main body controller 111 in step S53, and completes the procedure to return to the start of the operation for a sequential original document.

As previously described, when it is determined that the original document is not in the single face mode, the result of step S31 is NO, and the process proceeds to process D, where process D starts at step S61 of FIG. 24.

In step S61, the ADF controller 100 specifies the read motor speed of the document read motor 103 based on the read scan magnification, then receives the read start signal from the main body controller 111, and starts reading the original document.

After step S61, the ADF controller 100 drives the document read motor 103 to rotate in a normal direction, in step S62, so as to rotate the pair of read inlet rollers 37 and the pair of read outlet rollers 40 at the transfer speed according to the read scan magnification.

Then, in step S63, the ADF controller 100 determines whether the number of counted pulses of the document read motor 103 has reached a reference number of pulses for the front face of the original document, which corresponds to the distance of the registration sensor 41 and the scanning position 80 on the slit glass 22*b*.

When it is determined that the number of counted pulses of the document read motor 103 has not reached the reference number of pulses for the front face of the original document, the result of step S63 is NO, and the ADF controller 100 repeats step S63 until the number of counted pulses of the document read motor 103 reaches a reference number of pulses for the front face of the original document.

When it is determined that the number of counted pulses of the document read motor 103 has reached a reference number of pulses for the front face of the original document, the result of step S63 is YES, and the ADF controller 100 determines, in step S64, whether the number of correction pulses that account for the slip ratio and so forth of the original document has reached a reference number of pulses for the front face of the original document.

When it is determined that the number of correction pulses has not reached a reference number of pulses for the front face of the original document, the result of step S64 is NO, and the ADF controller repeats step S64 until the number of correction pulses reaches a reference number of pulses for the front face of the original document.

When it is determined that the number of correction pulses has reached a reference number of pulses for the front face of the original document, the result of step S64 is YES, the ADF controller 100 sends the gate signal that indicates an image area in the sub-scanning direction, to the main body controller 111 at the timing that the leading edge of the original document reaches the scanning position 80 in step S65.

After step S65, the ADF controller 100 starts counting the number of gate pulses for the front face of the original document in step S66, and determines whether the read outlet sensor 47 has been turned on to detect the leading edge of the original document, in step S67.

When it is determined that the read outlet sensor 47 has not been turned on to detect the leading edge of the original document, the result of step S67 is NO, and the ADF controller 100 determines whether the jam detection time has been over or not in step S68.

When it is determined that the jam detection time has not been over, the result of step S68 is NO, and the process goes back to step S67.

When it is determined that the jam detection time has been over, the result of step S68 is YES, and the ADF controller 100 determines that a jam indicating that leading edge of the original document to be discharged has not reached the read outlet sensor 47 has occurred and displays a message on the display panel 48 to inform the occurrence of the jam in step S69.

When it is determined that the read outlet sensor 47 has been turned on to detect the leading edge of the original document, the result of step S67 is YES, the ADF controller 100 turns on the switchback solenoid 105 before the leading edge of the original document that has passed through the scanning position 80 reaches the document discharging roller set 42 when reading the front face of the original document, so that the path switching member 44 can move to the position indicated by a chain double-dashed line shown in FIG. 2, and further drives the document switchback motor 104 to rotate in a normal direction in step S70.

With the above-described operations, the discharge drive roller 42*a* and the upper discharge driven roller 42*b* that are driven by the document read motor 103 and the pair of switchback rollers 45 that is driven by the rotation of the document switchback motor 104 in the normal direction can transfer the original document on the switchback path 46*a* as indicated by arrow B in FIG. 2.

After step S70, the ADF controller 100 determines whether the switchback sensor 49 has been turned on in step S71.

When it is determined that the switchback sensor 49 has not been turned on, the result of step S71 is NO, and the ADF controller 100 determines whether the jam detection time has been over or not in step S72.

When it is determined that the jam detection time has not been over, the result of step S72 is NO, and the process goes back to step S71.

When it is determined that the jam detection time has been over, the result of step S72 is YES, and the ADF controller 100 determines that a jam indicating that the original document has not reached the switchback sensor 49 has occurred and displays a message on the display panel 48 to inform the occurrence of the jam in step S73.

Figure 25:
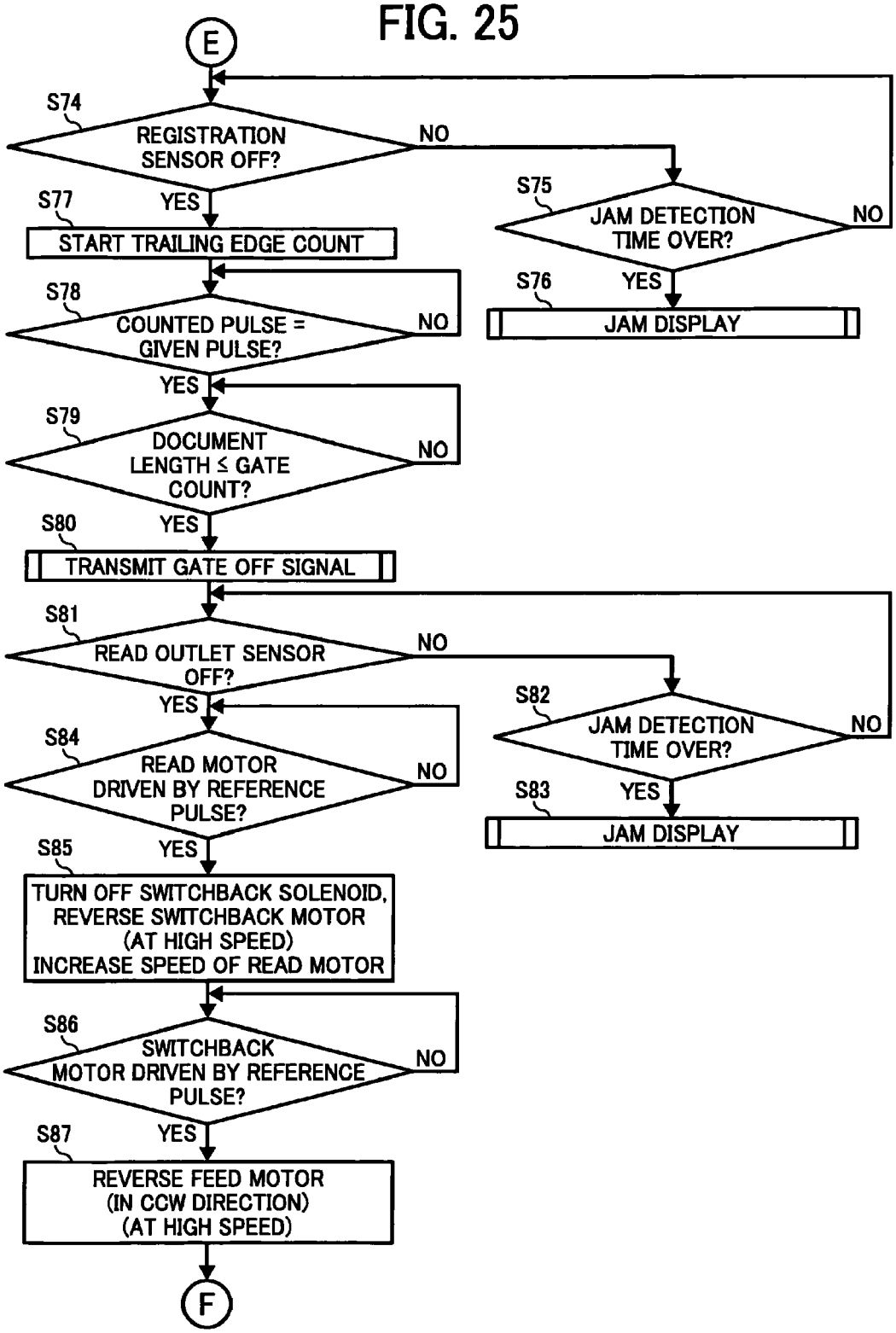
FIG. 25 is a flowchart (according to an example embodiment of the present patent application) continued from the flowchart shown in FIG. 24.

When it is determined that the switchback sensor 49 has been turned on, the result of step S71 is YES, and the process proceeds to process E, where process E starts at step S74 as shown in the flowchart of FIG. 25.

In step S74, the ADF controller 100 determines whether the registration sensor 41 has been turned off.

When it is determined that the registration sensor 41 has not been turned off, the result of step S74 is NO, and the ADF controller 100 determines whether the jam detection time has been over in step S75.

When it is determined that the jam detection time has not been over, the result of step S75 is NO, and the process returns to step S74.

When it is determined that the jam detection time has been over, the result of step S75 is YES, and the ADF controller 100 determines that a jam indicating that the original document has not completely passed the registration sensor 41 has occurred and displays a message on the display panel 48 to inform of the occurrence of the jam in step S76.

On the other hand, when it is determined that the registration sensor 41 has been turned off, the result of step S74 is YES, and ADF controller 100 starts the trailing edge count for counting the number of pulses of the document read motor 103, starting from the time that the trailing edge of the original document is not detected by the registration sensor 41 in step S77.

After step S77, the ADF controller 100 determines whether the number of counted pulses of the document read motor 103 has reached a reference number of pulses for the front face of the original document in step S78.

When it is determined that the number of counted pulses of the document read motor 103 has not reached a reference number of pulses for the front face of the original document, the result of step S78 is NO, and the ADF controller 100 repeats step S78 until the number of counted pulses of the document read motor 103 reaches a reference number of pulses for the front face of the original document.

When it is determined that the number of counted pulses of the document read motor 103 has reached a reference number of pulses for the front face of the original document, the result of step S78 is YES, and the ADF controller 100 determines, in step S79, whether the number of counted gate pulses is equal to or greater than the length of the original document.

When it is determined that the number of counted gate pulses is smaller than the length of the original document, the result of step S79 is NO, and the ADF controller 100 repeats step S79 until the number of counted gate pulses becomes equal to or greater than the length of the original document.

When it is determined that the number of counted gate pulses is equal to or greater than the length of the original document, the result of step S79 is YES, and the ADF controller 100 sends the gate off signal that indicates the image area in the sub-scanning direction in step S80, and determines whether the read outlet sensor 47 has been turned off in step S81.

When it is determined that the read outlet sensor 47 has not been turned off, the result of step S81 is NO, and the ADF controller 100 determines whether the jam detection time has been over in step S82.

When it is determined that the jam detection time has not been over, the result of step S82 is NO, and the process returns to step S81.

When it is determined that the jam detection time has been over, the result of step S82 is YES, and the ADF controller 100 determines that a jam indicating that the original document has not yet completely been discharged has occurred and displays a message on the display panel 48 to inform of the occurrence of the jam in step S83.

When it is determined that the read outlet sensor 47 has been turned off, the result of step S81 is YES, and the ADF controller 100 determines, in step S84, whether the document read motor 103 is driven by a reference number of pulses after the read outlet sensor 47 has detected the trailing edge of the original document.

When it is determined that the document read motor 103 is not driven by the reference number of pulses after the read outlet sensor 47 has detected the trailing edge of the original document, the result of step S84 is NO, and the ADF controller 100 repeats step S84 until the document read motor 103 is driven to rotate by the reference number of pulses.

When it is determined that the document read motor 103 is driven to rotate by the reference number of pulses after the read outlet sensor 47 has detected the trailing edge of the original document, the result of step S84 is YES, and the ADF controller 100 determines that a reference amount or length of the trailing edge of the original document has been projecting from the portion between the discharge drive roller 42*a* and the upper discharge driven roller 42*b*. At this time, the ADF controller 100 turns off the switchback solenoid 105, and returns the path switching member 44 to the position indicated by the solid line shown in FIG. 2. In addition, after the reference number of pulses has counted, the ADF controller 100 drives the document switchback motor 104 to rotate in a reverse direction at high speed to cause the pair of switchback rollers 45 to rotate in a reverse direction, and increases the speed of the document read motor 103, in step S85. Thereby, the original document may be transferred on the re-entry path 46*b* toward the pair of pull-out rollers 36 as indicated by arrow C in FIG. 2, so as to start scanning the reverse face of the original document that has been stopped at the registration stop position.

At this time, the document read motor 103 drives in the same direction, the document switchback motor 104 drives in the reverse direction, and the document switchback motor 104 and the document read motor 103 are driven in high speed. By so doing, the processing time can be reduced.

After step S85, the ADF controller 100 determines, in step S86, whether the document switchback motor 104 is driven by a reference number of pulses after the switchback sensor 49 has detected the leading edge of the original document.

When it is determined that the document switchback motor 104 is not driven to rotate by the reference number of pulses after the switchback sensor 49 has detected the leading edge of the original document, the result of step S86 is NO, and the ADF controller 100 repeats step S86 until the document switchback motor 104 is driven by the reference number of pulses.

When it is determined that the document switchback motor 104 is driven to rotate by the reference number of pulses after the switchback sensor 49 has detected the leading edge of the original document, the result of step S86 is YES, and the ADF controller 100 causes the document feed motor 102 to rotate in a counterclockwise direction, which is a direction to drive the pair of pull-out rollers 36, in step S87.

Figure 26:
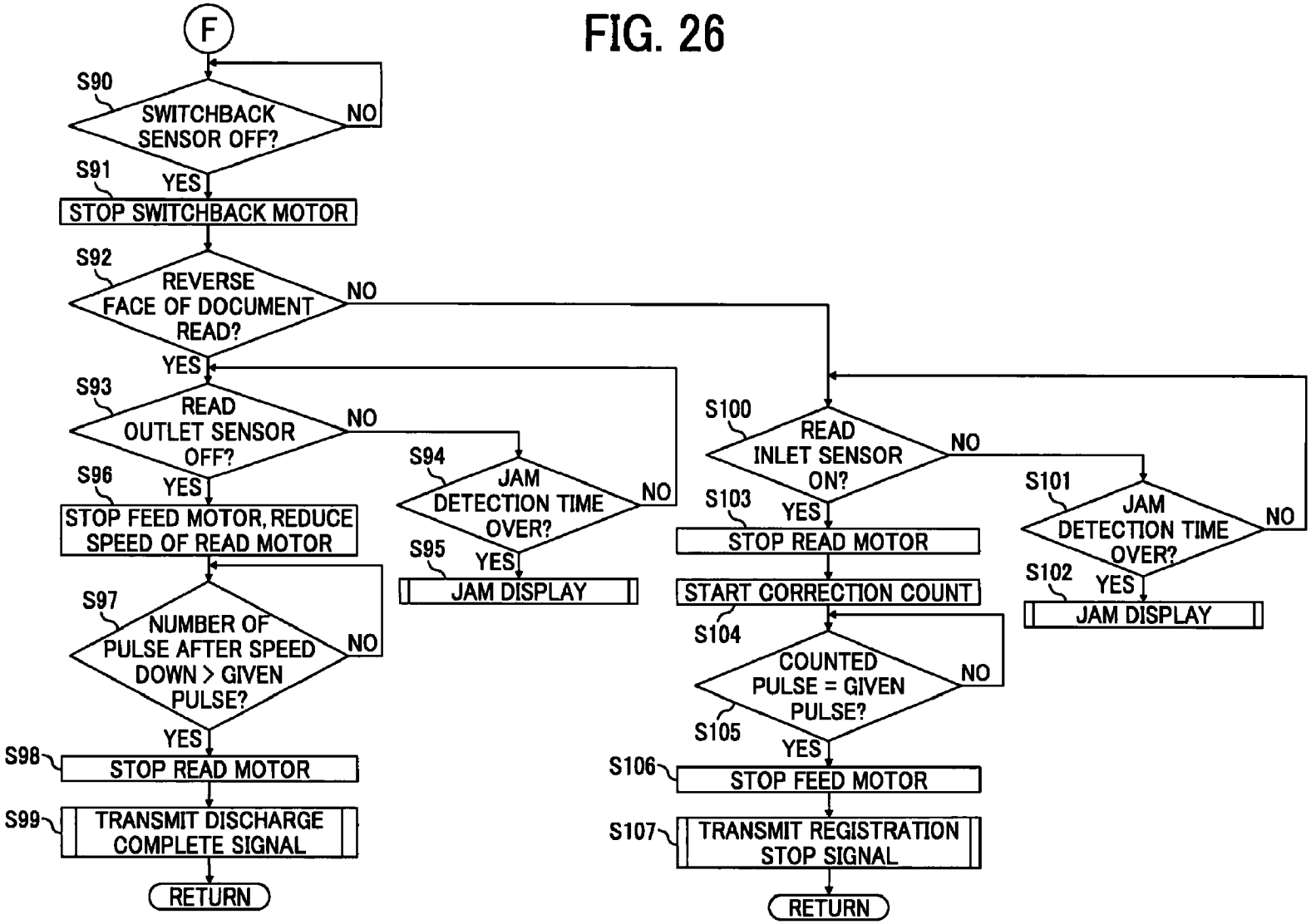
FIG. 26 is a flowchart (according to an example embodiment of the present patent application) continued from the flowchart shown in FIG. 25.

After step S87, the process proceeds to process F, where process F starts at step S90 in the flowchart of FIG. 26.

In step S90, the ADF controller 100 determines whether the switchback sensor 49 has been turned off.

When it is determined that the switchback sensor 49 has not been turned off, the result of step S90 is NO, and the ADF controller 100 repeats step S90 until the switchback sensor 49 is turned off.

When it is determined that the switchback sensor 49 has been turned off, the result of step S90 is YES, the ADF controller 100 stops the document switchback motor 104 in step S91, and determines whether the reverse face of the original document has been completely read, in step S92.

When it is determined that the reverse face of the original document has not been completely read, the result of step S92 is NO, and the ADF controller 100 causes the original document to be transferred to the re-entry path 46*b* toward the pair of pull-out rollers 36, as indicated by arrow C in FIG. 2, so as to read the reverse face of the original document. After the skew occurred to the original document has been corrected at the pair of pull-out rollers 36, the ADF controller 100 transfers the original document toward the pair of read inlet rollers 37.

The ADF controller 100 then determines whether the read inlet sensor 39 has been turned on, in step S100.

When it is determined that the read inlet sensor 39 has not been turned on, the result of step S100 is NO, the ADF controller 100 determines whether the jam detection time has been over, in step S101.

When it is determined that the jam detection time has not been over, the result of step S101 is NO, and the process returns to step S100.

When it is determined that the jam detection time has been over, the result of step S101 is YES, and the ADF controller 100 determines that a jam indicating that the leading edge of the original document has not passed the read inlet sensor 39 has occurred and displays a message on the display panel 48 to inform of the occurrence of the jam, in step S102.

When it is determined that the read inlet sensor 39 has been turned on, the result of step S100 is YES, the ADF controller 100 causes the document read motor 103 to stop to correct the skew occurred to the original document because of the pair of read inlet rollers 37 when reading the reverse face of the original document in step S103, and starts counting the number of drive pulses of the document feed motor 102 to correct the skew in step S104.

After step S104, the ADF controller 100 determines whether the number of counted pulses of the document feed motor 102 has reached a reference number of pulses in step S105.

When it is determined that the number of counted pulses of the document feed motor 102 has not reached the reference number of pulses, the result of step S105 is NO, and the ADF controller 100 repeats step S105 until the number of counted pulses of the document feed motor 102 reaches the reference number of pulses.

When it is determined that the number of counted pulses of the document feed motor 102 has reached the reference number of pulses, the result of step S105 is YES, and the ADF controller 100 causes the document feed motor 102 to stop in step S106, sends the registration stop signal to the main body controller 111 in step S107, and returns to the start of the operation shown in the flowchart in FIG. 22, for a next original document.

When receiving the read start signal from the main body controller 111, the ADF controller 100 executes the procedure from step S61 and after, so as to start reading the reverse face of the original document that is stopped at the registration stop position.

For reading the reverse face of the original document, the ADF controller 100 executes steps S61 through S91 in a same manner for reading the front face of the original document.

When reading the reverse face of the original document, the reference number of pulses in steps S63, S64, and S78 represent the reference number of pulses for the reverse face of the original document.

After executing steps S61 through S91, the ADF controller 100 determines, in step S92, whether the reverse face of the original document has been completely read, as previously described.

While the process proceeds to step S100 when it is determined that the reverse face of the original document has not been completely read, the process goes to step S100, when it is determined that the reverse face of the original document has been completely read, the result of step S92 is YES, the ADF controller 100 executes the third transfer of the original document to collate the pages in a proper order, without reading the original document. Then, the ADF controller 100 determines whether the read outlet sensor 47 has been turned off, in step S93.

When it is determined that the read outlet sensor 47 has not been turned off, the result of step S93 is NO, and the ADF controller 100 determines whether the jam detection time has been over in step S94.

When it is determined that the jam detection time has not been over, the result of step S94 is NO, and the process goes back to step S93.

When it is determined that the jam detection time has been over, the result of step S93 is YES, and the ADF controller 100 determines that a jam indicating that the original document has not been completely discharged has occurred and displays a message on the display panel 48 to inform of the occurrence of the jam, in step S95.

When it is determined that the read outlet sensor 47 has been turned off, the result of step S93 is YES, the ADF controller 100 determines that the original document has switched back for the third time and passed through the scanning position 80. After the determination, the ADF controller 100 causes the document feed motor 102 to stop the rotations of the document feed motor 102 and decrease the speed of the document read motor 103, in step S96.

After step S96, the ADF controller 100 determines, in step S97, whether the number of pulses of the document read motor 103 after the decrease of the speed thereof is greater than the reference number of pulses.

When it is determined that the number of pulses of the document read motor 103 after the decrease of the speed thereof is equal to or smaller than the reference number of pulses, the result of step S97 is NO, and the ADF controller 100 repeats step S97 until the number of pulses of the document read motor 103 after the decrease of the speed thereof becomes greater than the reference number of pulses.

When it is determined that the number of pulses of the document read motor 103 after the decrease of the speed thereof is greater than the reference number of pulses, the result of step S97 is YES, and the ADF controller 100 causes the document read motor 103 to stop the rotation thereof in step S98, and to send the document discharge completion signal to the main body controller 111 in step S99.

Figure 27:
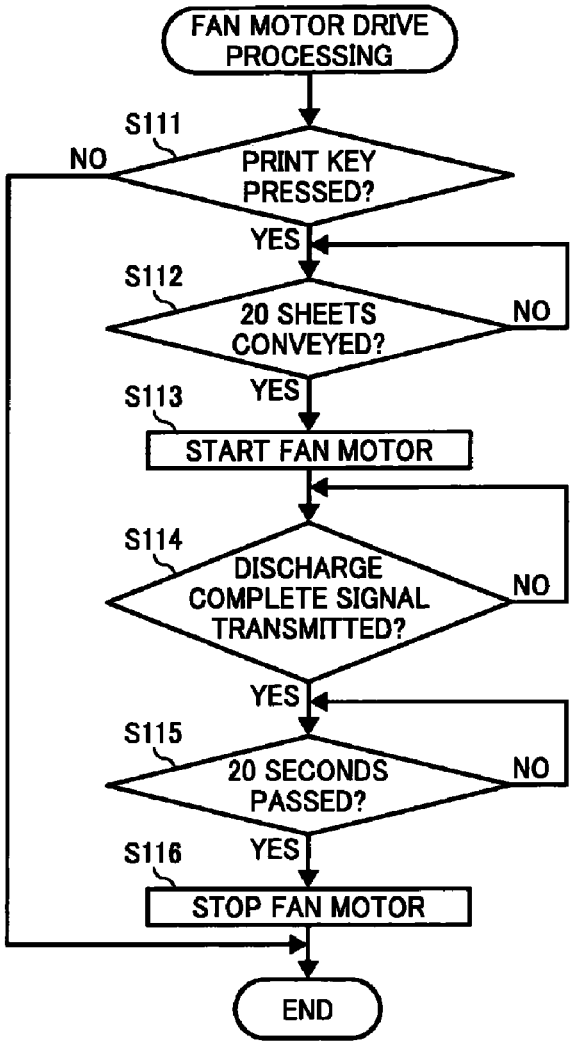
FIG. 27 is a flowchart (according to an example embodiment of the present patent application) of a fan motor driving operation performed in the image forming apparatus of FIG. 1.

Next, a fan motor driving operation is described, in reference to a flowchart shown in FIG. 27 is described.

In step S111 in the flowchart of FIG. 27, the ADF controller 100 determines whether the print key on the control panel 108 is pressed or not.

When it is determined that the print key is not pressed, the result of step S111 is NO, and the ADF controller 100 ends the operation.

When it is determined that the print key is pressed, the result of step S111 is YES, and the ADF controller 100 determines whether the number of transferred original documents has reached 20 sheets in step S112. By counting detection signals of the separation sensor 51 generated every time the trailing edge of the original document is detected, the ADF controller 100 obtains the number of transferred original documents.

When it is determined that the number of transferred original documents has not reached 20 sheets, the result of step S112 is NO, the ADF controller 100 repeats step S112 until the number of transferred original documents reaches 20 sheets.

When it is determined that the number of transferred original documents has reached 20 sheets, the result of step S112 is YES, the ADF controller 100 drives the fan motor 214 when starting conveyance of the 21st original document in step S113, and determines whether the discharge completion signal has been transmitted to the main body controller 111 in step S114.

When it is determined that the discharge completion signal has not been transmitted to the main body controller 111, the result of step S114 is NO, the ADF controller 100 repeats step S114 until the discharge completion signal is transmitted.

When it is determined that the discharge completion signal has been transmitted to the main body controller 111, the result of step S114 is YES, the ADF controller 100 determines whether 20 seconds have passed after the transmission of the discharge completion signal in step S115.

When it is determined that 20 seconds have not passed after the transmission of the discharge completion signal, the result of step S115 is NO, and the ADF controller 100 repeats step S115 until 20 seconds pass after the transmission of the discharge completion signal.

When it is determined that 20 seconds have passed after the transmission of the discharge completion signal, the result of step S115 is YES, and the ADF controller 100 stops driving the fan motor 214 in step S116, and completes the driving operation of the fan motor 214.

In this example embodiment of the present patent application, when the fan motor 214 is driven, air taken by the inlet 219 is supplied to the paths 217 and 222. The air to the path 217 cools down the motor brackets 210 and 212. By so doing, the switchback motor 104, and the document read motor 103 can be cooled down indirectly. The air supplied to the path 222 collides with the document feed motor 102, the switchback motor 104, and the document read motor 103 directly, thereby directly cooling the document feed motor 102, the switchback motor 104, and the document read motor 103 in this order. As described above, the paths 217 and 222 can effectively supply air to cool down the document read motor 103 disposed at an extreme downstream side from the fan motor 214.

After reaching the document read motor 103, as shown in FIG. 17, the air hits against the side wall 220, makes a turn, and flow together with other air as convected air. That is, cooled air collides with the document read motor 103 and the motor bracket 211 for a long period of time, which can surely cool down the document read motor 103 effectively. The air that collided with the side wall 220 and changed its direction is ejected from the outlet 218.

Figure 18:
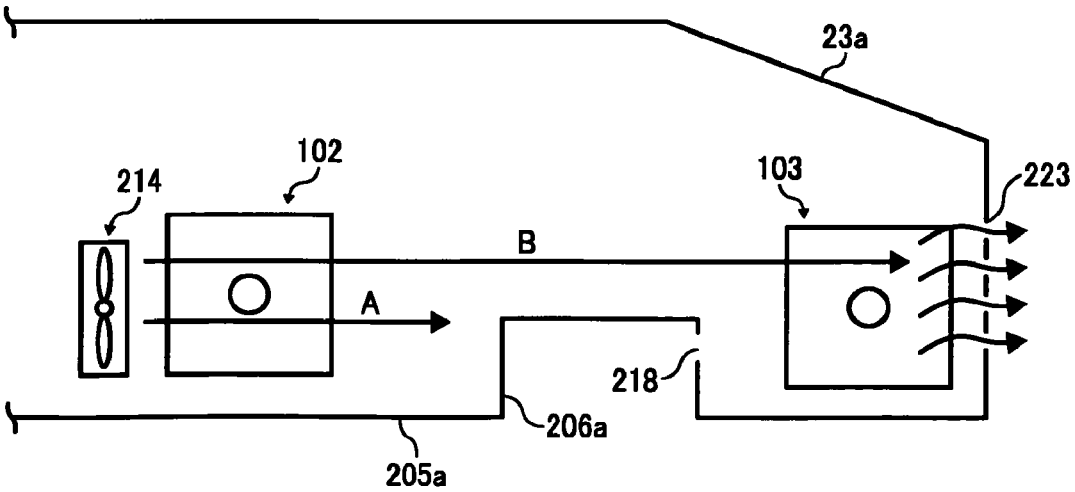
FIG. 18 is a schematic diagram showing air flow inside the automatic document feeder with a louver attached thereto.

It is possible to form a louver 223 on the side wall 220, as shown in FIG. 18, so as to eject the air therefrom. However, the configuration in this example embodiment is more preferable to effectively cool down the document read motor 103 disposed farthest or at an extreme downstream side from the fan motor 214 by bouncing the cooled air on the side wall 220 to hit against the document read motor 103 and the motor bracket 212. Further, the side wall 220 without the louver 223 can increase its rigidity and prevent foreign materials entering inside the ADF main body 23*a* from openings of the louver 223.

As described above, in the configuration of the example embodiment, the document feed motor 102, the document read motor 103, and the switchback motor 104 are arranged in a substantially in-line arrangement, so that air can be supplied along the direction of the document feed motor 102, the document read motor 103, and the switchback motor 104. Accordingly, the single fan motor 214 can effectively cool down multiple motors including the document feed motor 102, the document read motor 103, and the switchback motor 104 at the same time.

Therefore, the configuration of the example embodiment can reduce the installation space of the fan motor 214, and the size and manufacturing costs of the ADF 23. Further, a compact, inexpensive ADF 23 can also reduce the size and manufacturing costs of the copier 21. Specially, since the document feed motor 102, the document read motor 103, and the switchback motor 104 are arranged in a substantially in-line arrangement in the example embodiment, the ADF 23 can be lower in height, which can reduce the height of the copier 21.

Further, since the single fan motor 214 is sufficient, two or more fan motors 214 are not required. Therefore, an amount of power consumption to drive the fan motor 214 and sound or noise generated while driving the fan motor 214 can be reduced.

Further, air is supplied from the fan motor 214 serving as a cooling member that can be easily purchased and obtain a great effect of heat radiation.

Further, the outlet 218 for ejecting air is provided to the ADF main body 23*a* of the ADF 23 and disposed upstream from the document read motor 103 disposed at the most downstream side from the fan motor 214 in the air flow direction. With the configuration of the example embodiment, when air is supplied to the document read motor 103, the air can hit against the side wall 220 located near the document read motor 103 in the ADF main body 23*a* and change its course before ejecting from the outlet 218. By using convection of air as described above, the document feed motor 102, the document read motor 103, and the switchback motor 104 can be cooled down effectively.

Further, additional parts or components may not be needed to form the guide member, the manufacturing costs of the ADF 23 may not increase, and therefore, the manufacturing costs of the copier 21 may not increase.

Further, in the configuration of the example embodiment, the ADF main body 23*a* is attached to the copier main body 21*a* via the pair of openably closeable hinging units 20*a* and 20*b*. The pair of hinging units 20*a* and 20*b* is mounted on the lower cover 205*a* of the ADF main body 23*a* via the hinging unit attachment brackets 206*a* and 207 serving as hinging unit attachment member. The outlet 218 of air is formed at the gap between the hinging unit attachment bracket 206*a* on which the hinging unit 20*a* is mounted and the upper cover 205*b* of the ADF main body 23*a*. The inlet 219 of air is formed at the gap between the hinging unit attachment bracket 207 on which the hinging unit 20*b* is mounted and the upper cover 205*b* of the ADF main body 23*a*.

Therefore, no additional openings serving as the outlet 218 and the inlet 219 are needed to form on the ADF main body 23*a*, which can prevent the ADF main body 23*a* from degrading its rigidity.

Further, the guide member including the motor brackets 210 and 212, the rear wall 216, and the center wall 221 is provided to guide air from the fan motor 214 to the document read motor 103. Therefore, the document read motor 103 that is disposed farthest or at an extreme downstream side from the fan motor 214 can effectively be cooled down.

Further, in this example embodiment, the ADF controller 100 starts driving the fan motor 214 when the given number of original documents is separated and fed from the start of transfer of the original documents. Therefore, the ADF controller 100 does not drive the fan motor 214 when the temperatures of the document feed motor 102, the document read motor 103, and the switchback motor 104 have not reached a given temperature, thereby preventing the occurrence of noise from the fan motor 214 at the start of transfer of original document, i.e., at the start of a transfer job of original documents.

Since the ADF controller 100 counts the number of original documents separated and transferred, a simple, easy-to-program configuration can be achieve. Driving modes of the fan motor 214 are different for one side scanning and two-side scanning. To achieve a fine driving control of the fan motor 214, different numbers of original documents can be set for these modes for starting the fan motor 214.

Further in the example embodiment, the ADF controller 100 stops driving the fan motor 214 after a given period of time has passed since the completion of transfer of original documents. Therefore, the fan motor 214 drives only for a given time after the completion of transfer of original documents, thereby cooling the document feed motor 102, the document read motor 103, and the switchback motor 104 sufficiently and maintaining the document feed motor 102, the document read motor 103, and the switchback motor 104 under the sufficiently cooled condition until the start of a subsequent transfer job of original document.

The document feed motor 102, the document read motor 103, and the switchback motor 104 are arranged in a substantially in-line arrangement in the example embodiment, but not limited to. For example, only two motors of the document feed motor 102, the document read motor 103, and the switchback motor 104 can be arranged in a substantially in-line arrangement. In this case, a different fan motor can be provided to cool down the other motor disposed out of the substantially in-line arrangement.

Figure 28:
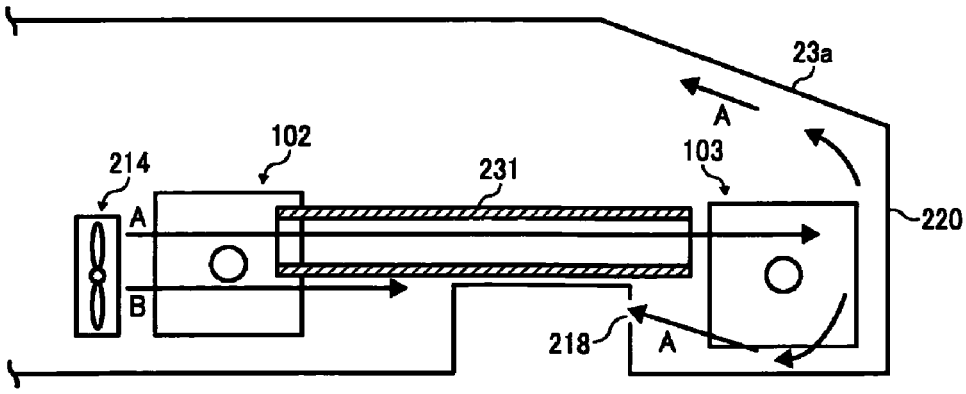
FIG. 28 is a schematic diagram showing air flow inside the automatic document feeder with a duct attached thereto.

The example embodiment includes the path 217 provided to a space surrounded by the motor bracket 210, the motor bracket 212, the bracket link 215, and the rear wall 216 of the ADF main body 23*a* to guide the flow of air from the fan motor 214 in the direction as indicated by arrow A in FIGS. 13 through 15, etc, but not limited to. For example, as shown in FIG. 28, a cylindrical duct 231 serving as a guide member may be provided between the fan motor 214 and the document read motor 103 so as to guide air from the fan motor 214 to the document read motor 103. By so doing, the document read motor 103 disposed farthest or at an extreme downstream side from the fan motor 214 can be cooled down effectively.

Further in this example embodiment, the ADF controller 100 starts driving the fan motor 214 when the given number of original documents is transferred from the start of transfer of the original documents, but not limited to. For example, the ADF controller 100 can start driving the fan motor 214 when a given period of time (for example, any time between 20 seconds and 30 seconds) has passed from the start of transfer of original documents accommodated on the document table 24.

When the fan motor 214 is started at the given number of original documents separated and transferred, the ADF controller 100 starts driving the fan motor 214 depending on differences of the size of the original documents, the transfer speed, etc. However, the above-described configuration causes the fan motor 214 to be started at the given period of time after the start of transfer of the original documents on the document table 24, and therefore the ADF controller 100 may not be affected by the differences of the size of the original documents, the transfer speed, etc. to start driving the fan motor 214. Accordingly, the ADF controller 100 can start driving the fan motor 214 when the temperatures of the document feed motor 102, the document read motor 103, and the switchback motor 104 increase, thereby effectively cooling the document feed motor 102, the document read motor 103, and the switchback motor 104.

Figure 29:
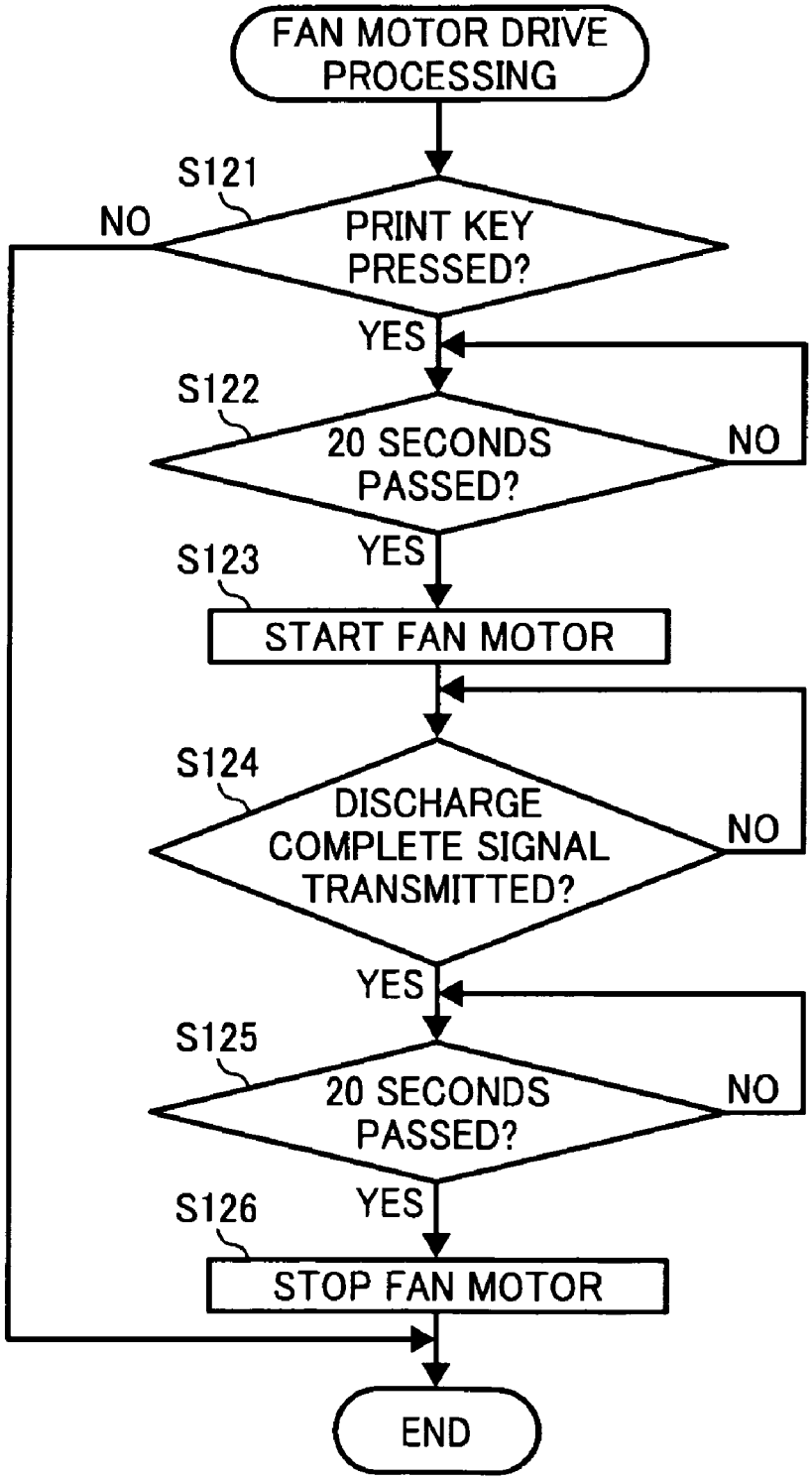
FIG. 29 is a flowchart (according to an example embodiment of the present patent application) of another fan motor driving operation performed in the image forming apparatus of FIG. 1.

Next, referring to FIG. 29, another fan motor driving operation is described.

In step S121 in the flowchart of FIG. 29, the ADF controller 100 determines whether the print key mounted on the control panel 108 is pressed or not.

When it is determined that the print key is not pressed, the result of step S121 is NO, and the ADF controller 100 ends the operation.

When it is determined that the print key is pressed, the result of step S121 is YES, and the ADF controller 100 determines whether 20 seconds have passed after the print key is pressed in step S122. At this time, the ADF controller 100 counts time according to a timer, not shown.

When it is determined that 20 seconds have not passed after the print key is pressed, the result of step S122 is NO, and the ADF controller 100 repeats step S122 until 20 seconds pass after the print key is pressed.

When it is determined that 20 seconds have passed after the print key is pressed, the result of step S122 is YES, and the ADF controller 100 starts driving the fan motor 214 in step S123, and determines whether the discharge completion signal has been transmitted to the main body controller 111 in step S124.

When it is determined that the discharge completion signal has not been transmitted to the main body controller 111, the result of step S124 is NO, the ADF controller 100 repeats step S124 until the discharge completion signal is transmitted.

When it is determined that the discharge completion signal has been transmitted to the main body controller 111, the result of step S124 is YES, the ADF controller 100 determines whether 20 seconds have passed after the transmission of the discharge completion signal in step S125.

When it is determined that 20 seconds have not passed after the transmission of the discharge completion signal, the result of step S125 is NO, and the ADF controller 100 repeats step S125 until 20 seconds pass after the transmission of the discharge completion signal.

When it is determined that 20 seconds have passed after the transmission of the discharge completion signal, the result of step S125 is YES, and the ADF controller 100 stops driving the fan motor 214 in step S126, and completes the driving operation of the fan motor 214.

Figure 30:
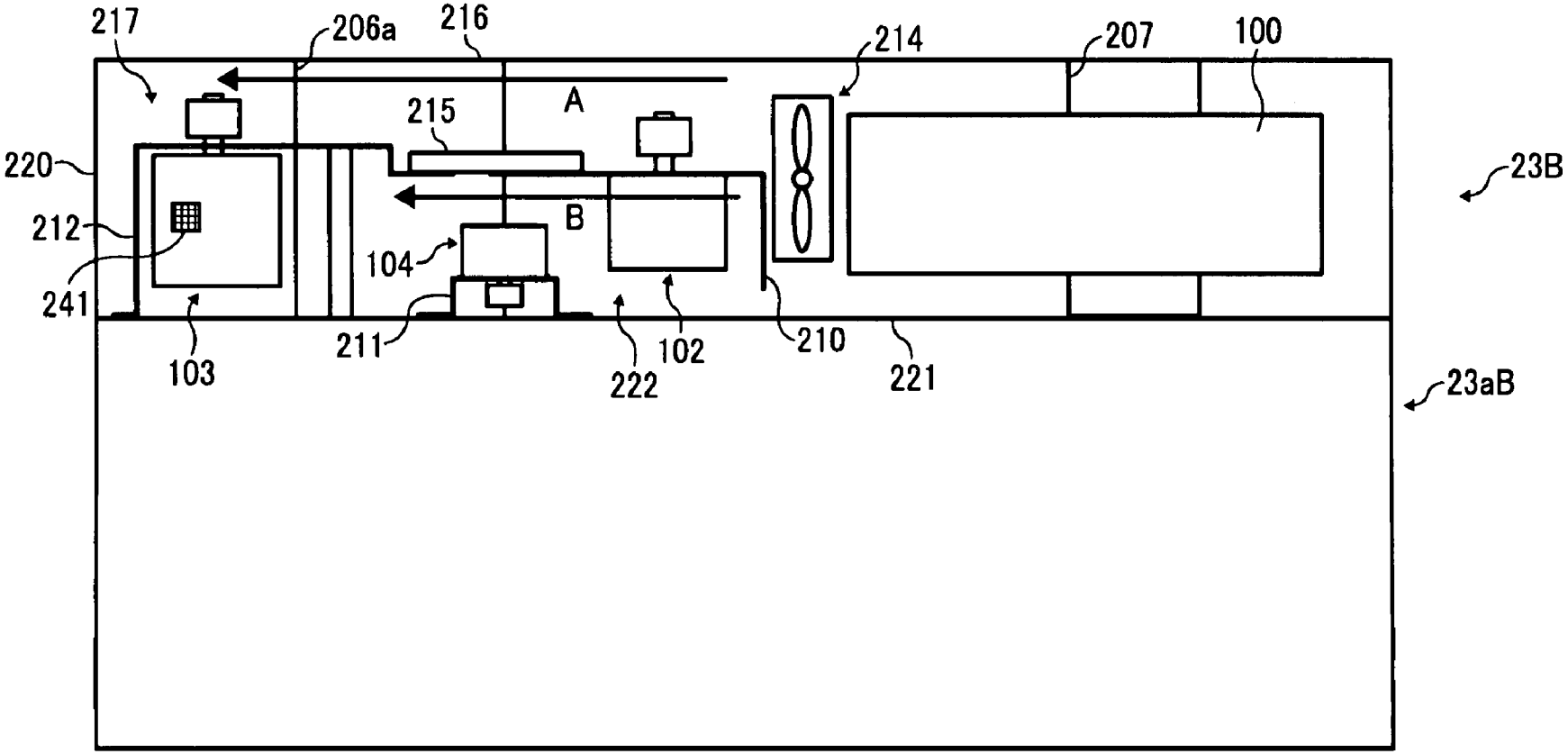
FIG. 30 is a schematic top view of another automatic document feeder (according to an example embodiment of the present patent application) included in an image reading system (according to an example embodiment of the present patent application) in an image forming apparatus according to an example embodiment of the present patent application.
Figure 31:
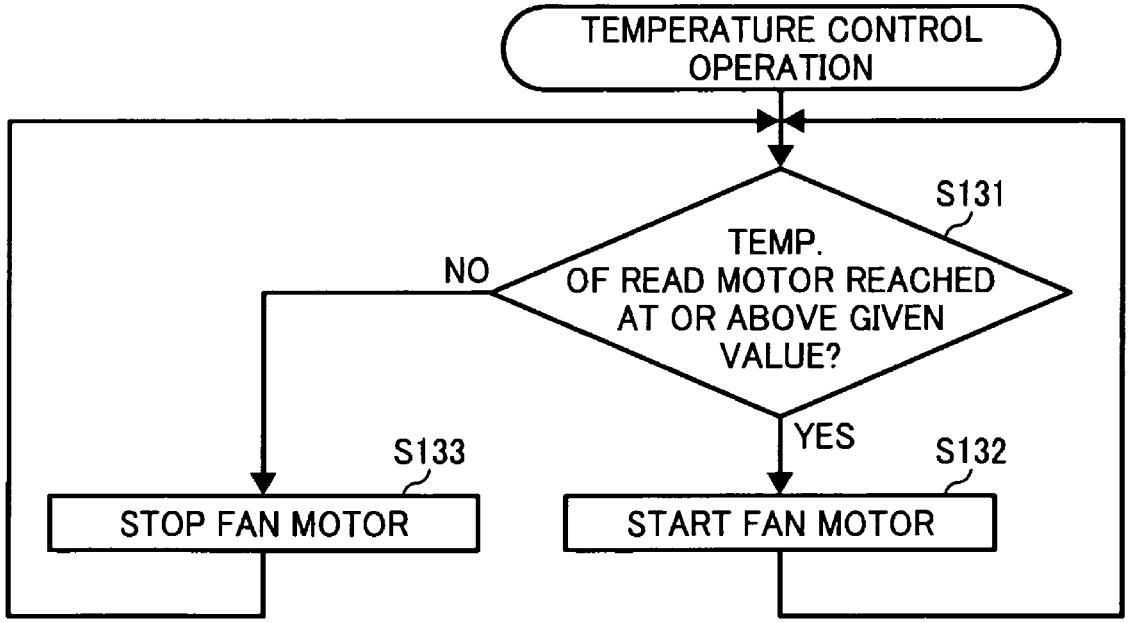
FIG. 31 is a flowchart (according to an example embodiment of the present patent application) of a temperature control operation performed in the image forming apparatus of FIG. 1.

Next, FIGS. 30 and 31 show a schematic configuration of an ADF 23B according to an example embodiment of the present patent application.

FIG. 30 is a top view of an ADF main body 23*a*B of the ADF 23B, and FIG. 31 is a flowchart showing a temperature control operation performed by the ADF controller 100.

Elements and members having the same functions and shapes are denoted by the same reference numerals throughout the present patent application and redundant descriptions are omitted. That is, the elements and members shown in FIG. 30 corresponding to those shown in FIGS. 1 through 29 are denoted by the same reference numerals, and descriptions thereof are omitted or summarized. Although not particularly described, configurations of the image forming components shown in FIG. 30, and operations that are not particularly described in this example embodiment are the same as the image forming components with reference to FIGS. 1 through 29.

In FIG. 30, the document read motor 103 disposed farthest or at an extreme downstream side from the fan motor 214 includes a temperature sensor 241 mounted thereon. The temperature sensor 241 serves as a temperature detector to detect a temperature of the document read motor 103. The ADF controller 100 starts driving the fan motor 214 when the temperature detected by the temperature sensor 241 is at a given value or above, and stops driving the fan motor 214 when the temperature is below the given value.

In an example embodiment, a temperature sensor can be mounted on each motor. However, the document read motor 103 is disposed far from the fan motor 214, and therefore the cooling effect is not so sufficient when compared with the document feed motor 102 and the switchback motor 104. Therefore, the temperature sensor 241 is provided only to the document read motor 103, which is effective in cost. That is, a temperature control of the document read motor 103 can cause the document feed motor 102 and the switchback motor 104 to be controlled at a lower temperature than the document read motor 103.

It is not limited to a farthest motor disposed at an extreme downstream side from the fan motor 214. For example, the temperature sensor 214 can be used to control a motor that is proved in a test to have a lowest cooling effect. There may be a time lag between a timing that the fan motor 214 is started and a timing that the document read motor 103 is beginning to be cooled down. Therefore, a preset temperature is generally set lower by 5K to 10K than an upper limit of a general standard temperature of the document read motor 103.

Next, the temperature control operation performed by the ADF controller 100 is described in reference to FIG. 31.

In step S131 in the flowchart of FIG. 31, the ADF controller 100 determines whether the temperature of the document read motor 103 is equal to or greater than the present temperature, according to the detection result of the temperature sensor 241.

When it is determined that the temperature of the document read motor 103 is equal or greater than the present temperature, the result of step S131 is YES, and the ADF controller 100 starts driving the fan motor 214 in step S132.

When it is determined that the temperature of the document read motor 103 is lower than the present temperature, the result of step S131 is NO, and the ADF controller 100 stops the fan motor 214 in step S133.

As described above, in the configuration of this example embodiment of the present patent application, the ADF controller 100 detects the temperature of the document read motor 103 disposed farthest or at an extreme downstream side from the fan motor 214, and starts the fan motor 214 when the temperature of the document read motor 103 becomes equal to or greater than the preset temperature. Therefore, this feedback control can surely cool down the document read motor 103 even though the document read motor 103 has a low cooling effect.

Further, when the temperature of the document read motor 103 becomes below the present temperature, the ADF controller 100 stops the fan motor 214. Therefore, after the document read motor 103 is cooled down according to the feedback control, the fan motor 214 stops, which can reduce or limit the power consumption of the fan motor 214.

In this example embodiment of the present invention, the fan motor 214 cools down the document feed motor 102, the document read motor 103, and the switchback motor 104, but not limited to. For example, it is possible that the fan motor 214 cools down the switchback solenoid 105, and respective motor drivers to drive the document feed motor 102, the document read motor 103, and the switchback motor 104.

As described above, the ADF 23 or 23B of the copier 21 can reduce its size and manufacturing cost. As a result, the copier 21 including the ADF 23 or 23B can reduced its size and manufacturing cost. Accordingly, the above-described example embodiments of the present patent application are useful to the ADF 23 or 23B, the scanner 81, the image reading system 20 including the ADF 23 or 23B and the scanner 81, and the image forming apparatus.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present patent application, and all such modifications as would be obvious to one skilled in the art are intended to be included within the scope of the following claims.

What is claimed is:

1. An automatic document feeder, comprising:

a document separation and feed unit configured to separate an original document placed on top of an original document stack on an original document stacker and feed the original document to be scanned;

a document conveyance unit configured to convey the original document separated and fed by the document separation and feed unit to a scanning position on an image reader;

a document discharging unit configured to discharge the original document conveyed to the scanning position by the document conveyance unit to a document discharging member;

a first drive unit configured to include a first motor to drive the document separation and feed unit;

a second drive unit configured to include a second motor to drive the document conveyance unit;

a third drive unit configured to include a third motor to drive the document discharging unit, at least two motors of the first motor, the second motor, and the third motor disposed in a substantially in-line arrangement;

a cooling member configured to supply a coolant to the at least two motors disposed in a substantially in-line arrangement, to the first motor, second motor, and third motor, in that order; and a document feeder main body connected to an image reader main body via a pair of hinging units, the pair of hinging units being attached to the document feeder main body via first and second hinging unit attachment members, the document feeder main body including an intake inlet configured to take the coolant into the main body of the automatic document feeder and disposed in a gap formed between the second hinging unit attachment member and the main body of the automatic document feeder, the discharge outlet being disposed in a gap formed between the first hinging unit attachment member and the document feeder main body, wherein a discharge outlet is disposed upstream from a motor of the first motor, second motor, and third motor which is disposed at an extreme downstream side in a direction of supply of the coolant to the motors.

2. The automatic document feeder according to claim 1, wherein the cooling member includes a fan motor and the coolant includes air, the fan motor supplying air.

3. The automatic document feeder according to claim 1, further comprising a guide member configured to guide the coolant supplied from the cooling member to a farthest motor of the first motor, second motor, and third motor which is disposed at an extreme downstream side from the cooling member.

4. The automatic document feeder according to claim 3, wherein the guide member comprises:

a supporting member including the at least two motors among the first motor, the second motor, and the third motor; and a wall plate included in the main body of the automatic document feeder disposed facing the supporting member.

5. The automatic document feeder according to claim 1, further comprising a drive controller configured to control the cooling member, the drive controller starting driving the cooling member when a given number of original documents is separated and fed from the start of transfer of the original documents accommodated on the original document stacker.

6. The automatic document feeder according to claim 5, wherein the drive controller stops driving the cooling member after a given period of time has passed since a completion of transfer of original documents.

7. The automatic document feeder according to claim 5, further comprising a temperature detector configured to detect a temperature of a farthest motor of the first motor, second motor, and third motor which is disposed at an extreme downstream side from the cooling member, the drive controller starting driving the cooling member when the temperature of the farthest motor detected by the temperature detector is at or above a given value.

8. The automatic document feeder according to claim 7, wherein the drive controller stops driving the cooling member when the temperature of the farthest motor detected by the temperature detector is below the given value.

9. The automatic document feeder according to claim 1, further comprising a drive controller configured to control the cooling member, the drive controller starting driving of the cooling member when a given period of time has passed from the start of transfer of original documents accommodated on the original document stacker.

10. The automatic document feeder according to claim 9, wherein the drive controller stops driving the cooling member after a given period of time has passed since a completion of transfer of original documents.

11. The automatic document feeder according to claim 9, further comprising a temperature detector configured to detect a temperature of a farthest motor of the first motor, second motor, and third motor which is disposed at an extreme downstream side from the cooling member, the drive controller starting driving the cooling member when the temperature of the farthest motor detected by the temperature detector is at or above a given value.

12. The automatic document feeder according to claim 11, wherein the drive controller stops driving the cooling member when the temperature of the farthest motor detected by the temperature detector is below the given value.

13. An image reading system, comprising:

an image reader configured to read an image on an original document at a scanning position; and an automatic document feeder configured to transfer the original document to the image reader, the automatic document feeder comprising:

a document separation and feed unit configured to separate an original document placed on top of an original document stack on an original document stacker and feed the original document to be scanned;

a document conveyance unit configured to convey the original document separated and fed by the document separation and feed unit to the scanning position;

a document discharging unit configured to discharge the original document conveyed to the scanning position by the document conveyance unit to a document discharging member;

a first drive unit configured to include a first motor to drive the document separation and feed unit;

a second drive unit configured to include a second motor to drive the document conveyance unit;

a third drive unit configured to include a third motor to drive the document discharging unit, at least two motors of the first motor, the second motor, and the third motor disposed in a substantially in-line arrangement;

a cooling member configured to supply a coolant to the at least two motors disposed in a substantially in-line arrangement, to the first motor, the second motor, and the third motor, in that order; and a document feeder main body connected to an image reader main body via a pair of hinging units, the pair of hinging units being attached to the document feeder main body via first and second hinging unit attachment members, the document feeder main body including an intake inlet configured to take the coolant into the main body of the automatic document feeder and disposed in a gap formed between the second hinging unit attachment member and the main body of the automatic document feeder, the discharge outlet being disposed in a gap formed between the first hinging unit attachment member and the document feeder main body, wherein a discharge outlet is disposed upstream from a motor of the first motor, second motor, and third motor which is disposed at an extreme downstream side in a direction of supply of the coolant to the motors.

14. An image forming apparatus, comprising:

an image forming unit configured to reproduce an image of an original document on a recording medium; and an image reading system including:

an image reader configured to read an image on an original document at a scanning position; and an automatic document feeder configured to transfer the original document to the image reader, the automatic document feeder comprising:

a document separation and feed unit configured to separate an original document placed on top of an original document stack on an original document stacker and feed the original document to be scanned;

a document conveyance unit configured to convey the original document separated and fed by the document separation and feed unit to the scanning position;

a document discharging unit configured to discharge the original document conveyed to the scanning position by the document conveyance unit to a document discharging member;

a first drive unit configured to include a first motor to drive the document separation and feed unit;

a second drive unit configured to include a second motor to drive the document conveyance unit;

a third drive unit configured to include a third motor to drive the document discharging unit, at least two motors of the first motor, the second motor, and the third motor disposed in a substantially in-line arrangement;

a cooling member configured to supply a coolant to the at least two motors disposed in a substantially in-line arrangement, to the first motor, the second motor, and the third motor, in that order; and a document feeder main body connected to an image reader main body via a pair of hinging units, the pair of hinging units being attached to the document feeder main body via first and second hinging unit attachment members, the document feeder main body including an intake inlet configured to take the coolant into the main body of the automatic document feeder and disposed in a gap formed between the second hinging unit attachment member and the main body of the automatic document feeder, the discharge outlet being disposed in a gap formed between the first hinging unit attachment member and the document feeder main body, wherein a discharge outlet is disposed upstream from a motor of the first motor, second motor, and third motor which is disposed at an extreme downstream side in a direction of supply of the coolant to the motors.

* * * * *